US008204412B2

(12) United States Patent
Kubo et al.

(10) Patent No.: US 8,204,412 B2
(45) Date of Patent: Jun. 19, 2012

(54) IMAGE FORMING APPARATUS GENERATING ELECTROSTATIC FORCES IN FIRST AND SECOND DIRECTIONS WITH A PREDETERMINED DUTY RATIO

(75) Inventors: Kenta Kubo, Kamakura (JP); Takeshi Yamamoto, Yokohama (JP); Manami Haraguchi, Yokohama (JP); Tomoaki Miyazawa, Tokyo (JP); Juun Horie, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 130 days.

(21) Appl. No.: 12/771,539

(22) Filed: Apr. 30, 2010

(65) Prior Publication Data

US 2010/0209147 A1 Aug. 19, 2010

Related U.S. Application Data

(63) Continuation of application No. PCT/JP2009/057402, filed on Apr. 10, 2009.

(30) Foreign Application Priority Data

Apr. 10, 2008 (JP) ..... 2008-102084

(51) Int. Cl.
*G03G 15/09* (2006.01)
*G03G 15/08* (2006.01)
*G03G 15/06* (2006.01)

(52) U.S. Cl. ..... 399/270; 399/53; 399/55

(58) Field of Classification Search ..... 399/53, 399/55, 252, 270

See application file for complete search history.

(56) References Cited

U.S. PATENT DOCUMENTS 5,678,130 A 10/1997 Enomoto et al.
6,040,102 A * 3/2000 Takahashi et al. ..... 430/108.6
6,278,856 B1 8/2001 Yamamoto
6,321,057 B1 11/2001 Yamamoto (Continued)

FOREIGN PATENT DOCUMENTS

JP 2000-284523 A 10/2000

(Continued)

OTHER PUBLICATIONS

Notification of Transmittal of Translation of the International Preliminary Report on Patentability mailed Dec. 9, 2010, forwarding an International Preliminary Report on Patentability dated Nov. 30, 2010 and Written Opinion of the International Searching Authority, in counterpart International Application No. PCT/JP2009/057402.

(Continued)

*Primary Examiner* — Sandra Brase

(74) *Attorney, Agent, or Firm* — Fitzpatrick, Cella, Harper & Scinto

(57) ABSTRACT

A duty ratio Du (%), denoted by (T2/(T1+T2))×100, is in the range of 60≦Du≦80; a magnetic carrier has a resistivity ρ which decreases in accordance with an increasing electric field strength, and a relative dielectric constant ∈ which increases in accordance with an increasing electric field strength; a product of a time constant $\in_0\in\rho(s)$ of electric charge decay in an electric field strength $E_{2D}$ decided by a second peak voltage $V_2$ and a dark potential $V_D$, and an electric field strength $E_{2D}$ satisfies a relation of $20 \leqq \in_0\in\rho E_{2D}$ (s·V/cm); and a time constant $\in_0\in\rho(s)$ and a relative dielectric constant ∈ in an electric field strength $E_{1L}$, which is decided by a first peak voltage $V_1$ and a bright potential $V_L$, satisfy the following relations: $\in_0\in\rho(s) \leqq 6.0\times10^{-4}$, and $30 \leqq \in$.

8 Claims, 13 Drawing Sheets

U.S. PATENT DOCUMENTS

| | | | | |
|---|---|---|---|---|
| 6,337,966 | B1 | 1/2002 | Yamamoto | |
| 6,381,434 | B1 | 4/2002 | Yamamoto | |
| 6,564,027 | B2 | 5/2003 | Haraguchi et al. | |
| 6,757,511 | B2 * | 6/2004 | Sugimoto et al. | 399/270 |
| 7,471,909 | B2 | 12/2008 | Haraguchi et al. | |
| 7,715,744 | B2 | 5/2010 | Miyazawa et al. | |
| 7,773,921 | B2 * | 8/2010 | Fujishima et al. | 399/273 |
| 2007/0048649 | A1 * | 3/2007 | Kobayashi et al. | 430/111.31 |
| 2007/0071472 | A1 * | 3/2007 | Kubo et al. | 399/51 |
| 2008/0025765 | A1 * | 1/2008 | Okada | 399/284 |
| 2008/0152396 | A1 | 6/2008 | Yamamoto et al. | |
| 2009/0123856 | A1 | 5/2009 | Hotta et al. | |

FOREIGN PATENT DOCUMENTS

| | | | |
|---|---|---|---|
| JP | 2002-116582 | A | 4/2002 |
| JP | 2002-258587 | A | 9/2002 |
| JP | 2005-215626 | A | 8/2005 |
| JP | 2006-259010 | A | 9/2006 |
| JP | 2007-183592 | A | 7/2007 |

OTHER PUBLICATIONS

Communication dated Feb. 24, 2012, forwarding a Supplementary European Search Report dated Feb. 17, 2012, in European Application No. 09729484.7-1240/2267553 PCT/JP2009057402.

* cited by examiner

101 : SURFACE LAYER
102 : CHARGE TRANSPORT LAYER
103 : CHARGE GENERATION LAYER
104 : UNDERCOAT LAYER
105 : SUPPORT MEMBER

111 : SURFACE LAYER
112 : CHARGE (ELECTRON) BLOCKING LAYER
113 : CHARGE GENERATION LAYER
114 : CHARGE (HOLE) BLOCKING LAYER
115 : SUPPORT MEMBER

IMAGE FORMING APPARATUS GENERATING ELECTROSTATIC FORCES IN FIRST AND SECOND DIRECTIONS WITH A PREDETERMINED DUTY RATIO

BACKGROUND OF THE INVENTION

1. Field of the Invention

The present invention relates to an electrophotographic image forming apparatus, and in particular, it relates to an image forming apparatus suitable for an image bearing member of high electrostatic capacitance.

2. Description of the Related Art

In recent years, electrophotographic copying machines or the like are expected to go into the printing market in accordance with the progress of techniques in the image forming apparatus. However, in order to enter the printing market in full scale, it is an essential requirement that the quality and stabilization of images be made much higher than the present ones.

Until today, various approaches to improve image quality have been actively carried out, and among those, an approach to an image bearing member is taken up. As an important factor to decide image quality, there is an electrostatic latent image formed on the image bearing member. The electrostatic latent image is formed by decaying an exposed part on the image bearing member, which has been charged to a dark potential VD by means of a primary charger, to a bright potential VL by laser exposure.

Here, a detailed explanation will be given to a general formation process of an electrostatic latent image.

FIG. 1 is a layer construction of a general organic photoconductor (OPC) as an image bearing member.

That is, a charge generation layer 103, a charge transport layer 102, and a surface layer 101 are laminated on a support member 105 through an undercoat layer 104. The exposed light is absorbed in the charge generation layer 103 to produce charge carriers. The charge carriers thus produced are injected into the charge transport layer 2, so that they move in the charge transport layer 2 to neutralize the dark potential VD. As a result, the exposed part is decayed to the bright potential VL, whereby an electrostatic latent image is formed. In general, it is known that when the film thickness of the image bearing member is thick, the electrostatic latent image formed thereon is deteriorated. If the electrostatic latent image is deteriorated, dot reproducibility also gets worse, so it is of course impossible to obtain an image of high quality as desired.

Therefore, the thinning of the film thickness of the image bearing member is performed as one of the approaches to the image bearing member for high image or picture quality. According to the study of the inventors, it has been found that in order to achieve the dot reproducibility allowed in OPC, the film thickness should be equal to or less than 20 μm (hereinafter referred to as a thin film OPC).

On the other hand, an amorphous silicon photosensitive member (hereinafter referred to as α-Si photosensitive member) is taken up as another approach for high picture quality. FIG. 2 is a layer construction of the α-Si photosensitive member. This α-Si photosensitive member includes a charge generation layer 113, an electric charge (electron) blocking layer 112 and a surface layer 111 laminated on a support member 115 through an electric charge (hole) blocking layer 114. The α-Si photosensitive member can create the charge generation layer 113 in the vicinity of the surface layer 111, and hence it can suppress the diffusion of electric charge to a great extent, as shown in FIG. 2.

According to the study of the present inventors, it has been found that the film thickness should be 60 μm or less in order to achieve the dot reproducibility allowed in the α-Si photosensitive member. In addition, it has been found that the α-Si photosensitive member is very high in hardness as compared with the OPC, and hence has a sufficiently allowable level of durability as required in the printing market.

As described above, the thinning of the film thickness of the charge transport layer in the image bearing member and the use of the α-Si photosensitive member are picked up as approaches for high picture quality in the electrophotographic image forming apparatus. It can be said that among these approaches, the α-Si photosensitive member is capable of outputting pictures of high quality comparable to the printing level and at the same time has excellent durability as required in the printing market.

Here, note that as an image forming apparatus using an α-Si photosensitive member, there is one described in Patent Literature 1, for example.

CITATION LIST

Patent Literature

[PTL 1] Japanese patent application laid-open No. 2002-258587

SUMMARY OF THE INVENTION

However, the α-Si photosensitive member is liable to be subjected to a "charging defect" in which development is not terminated normally. Hereinafter, the "charging defect" will be discussed.

FIG. 3 illustrates a latent image potential in the highest density portion (hereinafter a solid portion) in an image part. A developing bias required to output the highest density is applied on the bright potential $V_L$ of the solid portion. The developing bias applied at this time is called Vdc, and a difference between Vdc and $V_L$ is called a developing contrast (Vcont). The development of the solid portion is carried out in such a manner that a potential (hereinafter referred to as a charging potential (ΔV)) generated by the toner being developed can fill the development contrast (Vcont). Then, the development is terminated normally at the instant when the charging potential has filled out Vcont (FIG. 4). Here, $V_D$ denotes a dark potential in a non-image part, and a difference between the dark potential $V_D$ and the DC component of developing bias Vdc is called a fog removing potential.

However, if the α-Si photosensitive member is used, the development is finished in a state where the charging potential has not fully filled out Vcont even at the time of termination of the development, as shown in FIG. 5. Such a phenomenon is called a "charging defect".

Now, reference will be made to the reason why the α-Si photosensitive member is liable to cause a charging defect. The charging potential generated by the latent image being developed by the toner is denoted as ΔVth in a theoretical sense, as shown by the following Equation 1.

$$\Delta Vth = \Delta Vt + \Delta Vc = \frac{dt}{2\varepsilon_0\varepsilon_t}\left\langle\frac{Q}{S}\right\rangle + \frac{dm}{\varepsilon_0\varepsilon_m}\left\langle\frac{Q}{S}\right\rangle \quad \text{Equation 1}$$

In the above-mentioned Equation 1, dt denotes the height of a toner layer; dm denotes the film thickness of the image bearing member (the total film thickness except for the support member); Q/S denotes the amount or quantity of charge per unit area of the toner; $\in_0$ denotes the dielectric constant of a vacuum; $\in_t$ denotes the dielectric constant of the toner layer; and $\in_m$ denotes the relative dielectric constant of the image bearing member. Here, note that the individual units are represented in such a manner that the dimensions of Equation 1 may be consistent.

In Equation 1 above, the first term is a potential ΔVt which is created by the toner layer itself with respect to its surroundings; the second term is ΔVc created between the toner layer and a basic layer of the image bearing member by means of a capacitor effect. The sum of both of these terms becomes the potential generated upon development by the toner, i.e., the charging potential ΔVth. Here, note that ΔV is a measured value of the charging potential, and ΔVth is a theoretical value of the charging potential (i.e., a value derived from Equation 1).

In addition, the film thickness dm of the image bearing member indicates the actual film thickness of a photosensitive layer, and hence indicates the film thickness of the layer excluding the support member. Specifically, in case of the α-Si photosensitive member, the film thickness dm of the image bearing member is a film thickness that is the sum of the surface layer 111, the electric charge blocking layers 112, 114, and the charge generation layer 113 except for the support member 115 of FIG. 2.

On the other hand, in the case of OPC, the film thickness dm of the image bearing member is a film thickness that is the sum of the surface layer 101, the charge transport layer 102, and the charge generation layer 103 except for the support member 105 and the undercoat layer 104 of FIG. 1, and in the case of absence of the surface layer 101, it is a film thickness that is the sum of the charge transport layer 102 and the charge generation layer 103. Here, note that in case where the undercoat layer 104 is formed on the support member 105, the thickness of the undercoat layer 104 is not included in the film thickness dm of the image bearing member.

Here, note that in the case of using the α-Si photosensitive member for high picture quality, the relative dielectric constant of the α-Si photosensitive member becomes about three times as large as that of OPC. In other words, the electrostatic capacitance per unit area C/S ($=\in_0\in m/dm$) of the α-Si photosensitive member becomes about three times as large as that of OPC with the same film thickness. If the electrostatic capacitance is large, ΔVc in the second term of Equation 1 decreases, from the relation of Q=CV, even if the toner with the same quantity of charge is developed.

For this reason, the α-Si photosensitive member is liable to cause a charging defective. The same is true for the thin film OPC. The thin film OPC has a film thickness thinner than a conventional one, and hence has a larger electrostatic capacitance than that with the conventional film thickness. Thus, ΔVc becomes lower, resulting in that defective charging may be easily caused.

FIG. 6 illustrates the amount of the toner (mg/cm$^2$) on the image bearing member in the solid portion at Vcont when the nearest distance between the developer carrying member and the image bearing member (hereinafter referred to as an SD gap) is 300 μm and 400 μm, respectively. When the SD gap is 300 μm, the OPC of the conventional film thickness (30 μm) has a charging efficiency of 100%, but the α-Si photosensitive member of the same film thickness (30 μm) decreases to a charging efficiency of 70%. At this time, when there is a fluctuation or variation of 100 μm in the SD gap (i.e., SD of 400 μm), there is substantially no change in the amount of developed toner with OPC, but there is a great change in the amount of developed toner with the α-Si photosensitive member.

The reasons for this will be described below. For the α-Si photosensitive member, development has not been terminated normally due to defective charging. In other words, for the electrostatic latent image, the development has been terminated with sufficient energy for developing the toner being left. Therefore, the amount of developer can be varied greatly by a change in the electric field strength due to fluctuation of the SD gap, etc.

On the contrary, in case that development has been terminated normally as with OPC, there is a limited amount of energy for development left, so the change of the amount of developer is small even if the electric field strength should change. Therefore, it has been found that the stability of the amount of developed toner is extremely decreased by the defective charging resulting from providing high electrostatic capacitance. In the printing market, it is required that all the output pictures have high picture quality and at the same time the same picture quality. In other words, it is required that the amount of toner, which decides the density of image to be obtained, do not change for all the output images. To achieve this, it is essential to solve the above-mentioned defective charging.

Accordingly, by changing the film thickness of the OPC to 30 μm, 25 μm, 20 μm, respectively, the resultant charging rates measured were 100% (for 30 μm), 90% (for 25 μm), and 75% (for 20 μm), respectively. At this time, from the above-mentioned measurements, it was found that with respect to a fluctuation of 100 μm of the SD gap, the changes of the amount of developer were small for the film thickness of 30 μm (i.e., charging rate of 100%), and for the film thickness of 25 μm (i.e., charging rate of 90%), and hence were within the allowable level of stability. According to the above-mentioned technical reasons, the charging efficiency should be 90% or more.

In order to cope with the above-mentioned increased electrostatic capacitance of the image bearing member, a variety of attempts have been made to improve defective charging.

In order to solve defective charging for the above-mentioned increased electrostatic capacitance of the image bearing member, previously, it has been made to use a development bias which made a toner fly to the image bearing member from the developer carrying member actively.

However, the use of such development bias caused the another problem what is called "fog" to which a toner adheres also to a non-image part other than an image part.

Therefore, the image forming apparatus of not causing the problem of the fog, either is desired, raising a charging rate.

In view of the above, an object of the present invention is to provide an image forming apparatus in which, upon use of an image bearing member of high electrostatic capacitance, is capable of solving the problem of defective charging without deteriorating a fog thereby to make high picture quality and high stability compatible with each other.

Bearing the above object in mind, an image forming apparatus according to the present invention includes:

an image bearing member that bears an electrostatic image thereon;

a charging device that charges the image bearing member;

an exposure device that forms the electrostatic image by exposing a surface of the image bearing member, which has been charged to a dark potential $V_D$ by means of the charging device, thereby to change the image bearing member surface into a bright potential $V_L$;

a developing device that has a developer carrying member on which a developer including a toner and a magnetic carrier is carried; and a power supply that applies a developing bias on the developer carrying member;

wherein the developing bias is an oscillating voltage having a first peak voltage $V_1$ generating electrostatic force in a first direction to cause the toner to move in a direction from the developer carrying member toward the image bearing member, and a second peak voltage $V_2$ generating electrostatic force in a second direction to cause the toner to move in a direction from the image bearing member toward the developer carrying member, the first and second peak voltages being applied on the developer carrying member in an alternate manner;

a duty ratio Du (%), denoted by $(T2/(T1+T2))\times 100$, is between 60 and 80 (i.e., $60 \leqq Du \leqq 80$), where T1 is a phase time in the first direction, and T2 is a phase time in the second direction;

the magnetic carrier has a characteristic that:

the magnetic carrier has a resistivity ρ which decreases in accordance with an increasing electric field strength, and a relative dielectric constant ∈ which increases in accordance with an increasing electric field strength;

a product of a time constant $\in_0 \in \rho(s)$ of electric charge decay, which is denoted by a dielectric constant of a vacuum $\in_0$, the relative dielectric constant ∈ of the magnetic carrier, and the resistivity ρ in an electric field strength $E_{2D}$ decided by the second peak voltage $V_2$ and the dark potential $V_D$, and the electric field strength $E_{2D}$ satisfies a relation of $20 \leqq \in_0 \in \rho E_{2D}$ (s·V/CM); and the time constant $\in_0 \in \rho(s)$ and the relative dielectric constant E in an electric field strength $E_{1L}$, which is decided by the first peak voltage $V_1$ and the bright potential $V_L$, satisfy the following relations: $\in_0 \in \rho(s) \leqq 6.0\times 10^{-4}$, and $30 \leqq \in$.

By using the magnetic carrier and duty bias under a predetermined condition, it is satisfied both a required level of fog and a required level of charging rate.

Further features of the present invention will become apparent from the following description of exemplary embodiments with reference to the attached drawings.

DESCRIPTION OF THE EMBODIMENTS

Now, the present invention will be described in detail below based on illustrated preferred embodiments thereof.

(1) Example of Image Forming Apparatus

Figure 16:
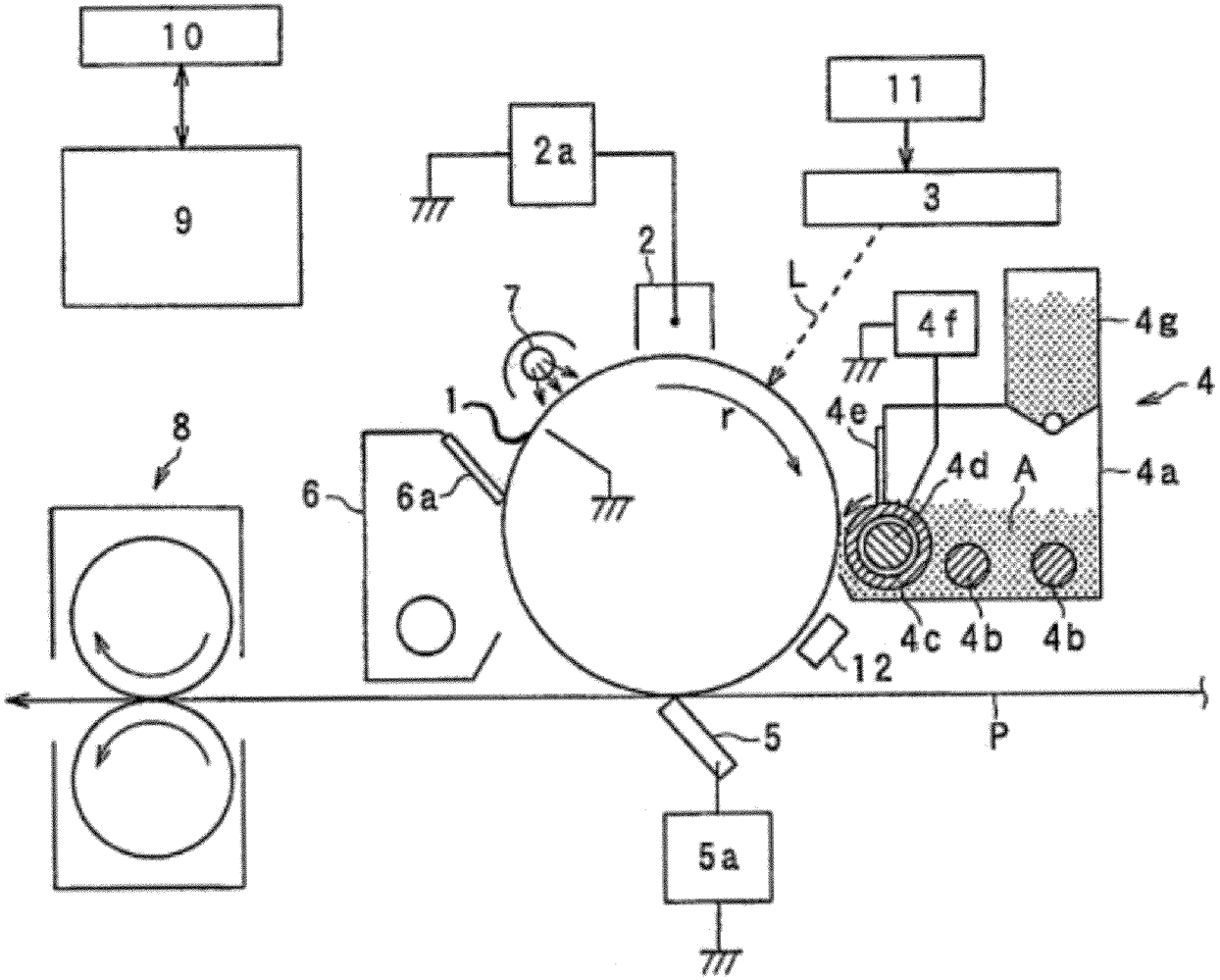
FIG. 16 is a schematic construction view illustrating one example of an image forming apparatus according to the present invention.

FIG. 16 is a schematic construction view illustrating one example of an image forming apparatus according to the present invention. This image forming apparatus is a laser beam printer of a digitalized image exposure type and a reversal development type, utilizing an electrophotographic process.

In this example, the image forming apparatus is in the form of a laser beam printer of a digitalized image exposure type and a reversal development type, but it includes laser beam printers of a background exposure type, a normal development type, and so on, all of which are encompassed by the scope of the appended claims of the present invention.

A reference numeral 1 denotes a drum type electrophotographic photosensitive member which acts as an image bearing member. In order to improve dot reproducibility, it is effective to make a charge density on the surface of the image bearing member high. So this image bearing member 1 has a high electrostatic capacitance, and in particular, an electrostatic capacitance per unit area (C/S) of $1.5\times 10^{-6}$ (F/m$^2$) or higher (i.e., $C/S \geqq 1.5\times 10^{-6}$ (F/m$^2$)). In order to achieve allowable dot reproducibility, it is required that an α-Si photosensitive member have a film thickness of 60 μm or less, and that a thin film OPC have a film thickness of 20 μm or less. At this time, a lower limit of an electrostatic capacitance per unit area (C/S) ($=\in_0 \in m/dm$) is $1.5\times 10^{-6}$ (F/m$^2$) (i.e., $C/S=1.5\times 10^{-6}$ (F/m$^2$)) For the purpose of obtaining high picture quality, it is preferable to satisfy the above-mentioned condition ($C/S \leqq 1.5\times10^{-6}$ ($F/m^2$)). Therefore, since the larger a value of C/S is, the better a dot reproducibility becomes, in the viewpoint of dot reproducibility, there is no upper limit for the value of C/S.

However, in case of a value of C/S is increase, defective charging is liable to be caused, as stated above. Then, due to defective charging, the stability of development is reduced to an extreme extent.

In this example, the image bearing member 1 is an amorphous silicon photosensitive member (α-Si photosensitive member). The α-Si photosensitive member is basically provided with a photosensitive layer including amorphous silicon on a conductive substrate body. The photosensitive layer is formed of an amorphous silicon-based material such as Si, SiC, SiO, SiON, or the like. The photosensitive layer is formed, for instance, by means of a glow discharge decomposition method, a sputtering method, an ECR method, a deposition method, or the like.

The image bearing member 1 is driven to rotate at a predetermined speed in a clockwise direction denoted by arrow r, and has a surface which is uniformly charged to a predetermined dark potential $V_D$ by means of a primary charger (charging device) 2. 2*a* denotes a charging bias power supply for the primary charger 2. 3 denotes a laser scanner (laser exposure device) which acts as a digitalized exposure unit. A time series electric digital pixel signal is input to the scanner 3 from a host apparatus 11 such as an image scanner.

That is, in the host apparatus 11, an image signal acquired by a CCD or the like is digitalized by an A/D converter, and is then sent to a signal processing unit where it is converted into a binary image signal corresponding to the density of an image.

This image signal is sent to the scanner 3. The scanner 3 has a laser driver, a laser, a rotary polygon mirror, a mirror, and so on, and the image signal is input to the laser driver. The laser driver modulates the light emission of the laser in accordance with the image signal input thereto.

The dark potential surface of the image bearing member 1 is subjected to scanning exposure L (image exposure) by the modulated laser beam. The dark potential $V_D$ of the exposed portion decays to a bright potential $V_L$, so that an electrostatic latent image is formed. An image exposure method is a method in which a portion of an image bearing member to which a toner is to be adhered at the time of development is pre-exposed, and a bright potential portion of the image bearing member is developed by the toner.

Numeral 4 denotes a developing device that develops the electrostatic latent image formed on the surface of the image bearing member 1 as a toner image. The developing device 4 of this example is a reversal development device that uses, as a developer, a two-component developer A comprising a magnetic carrier and a non-magnetic toner. The ratio by weight between the toner and the carrier is adjusted to a predetermined value. The developer A is received in a developing container 4*a*, and is stirred by a stirring member 4*b*, so that the toner is friction-charged to a negative polarity. The developer A is supplied to a developing sleeve 4*c*, which act as a developer carrying member.

The developing sleeve 4*c* is driven to rotate at a predetermined speed in a counterclockwise direction denoted by an arrow. In the developing sleeve 4*c*, there is arranged a magnet roller 4*d* which is composed of a magnetic material and which has a plurality of magnetic poles. The developer A supplied to the developing sleeve 4*c* is carried, as a magnetic brush layer, on the surface of the developing sleeve 4*c* by the magnetic force of the magnet roller 4*d*, and is conveyed in accordance with the rotation of the developing sleeve 4*c*. The developer A is conveyed to a development region in which the developing sleeve 4*c* and the image bearing member 1 are arranged in opposition to each other, with the layer thickness of the developer A being restricted by a blade 4*e* in the course of conveyance thereof.

A predetermined developing bias is applied on the developing sleeve 4*c* by means of a developing bias applying power supply 4*f*. By the application of this developing bias, a developing electric field is generated in the development region, whereby the toner adhered to the carrier is pulled away from the carrier, and the electrostatic latent image on the image bearing member 1 is reversely developed by the negative carrier. In the reversal development method, the polarity to which the image bearing member is charged by the charger is the same as the charging polarity of the toner.

The developer magnetic brush layer supplied for development in the development region is conveyed back into the developing container 4*a* in accordance with the continued rotation of the developing sleeve 4*c*, so that it is magnetically stripped off from the surface of the developing sleeve 4*c*. Then, a fresh developer is supplied to the developing sleeve 4*c*. The toner density of the developer A in the developing container 4*a* decreases as the toner in the developer A is consumed by development. To compensate for this, the toner density of the developer A in the developing container 4*a* is observed by means of an unillustrated sensor. When the toner density of the developer A has decreased to an allowable lower limit density, an operation to replenish an appropriate amount of toner in a replenishment toner container 4*g* to the developer A in the developing container 4*a* is carried out in an intermittent manner. As a result, the toner density of the developer A in the developing container 4*a* is kept within a predetermined range.

The toner image formed on the image bearing member 1 is successively transferred, by means of a transfer device in the form of a transfer charger 5, to a recording material (transfer material) P such as a sheet of paper, which is fed from an unillustrated sheet feeding part to the opposed portions of the image bearing member 1 and the transfer charger 5 at predetermined control timing. A transfer bias of a positive polarity opposite to the charging polarity of the toner is applied from a transfer bias applying power supply 5*a* to the transfer charger 5 at predetermined control timing. As a result, the toner image on the image bearing member 1 is electrostatically transferred to a surface of the recording material P.

The recording material P having passed the transfer device in the form of the transfer charger 5 is separated from the surface of the image bearing member 1, so that it is introduced into a fixing device 8. The fixing device 8 fixes the unfixed toner image on the recording material P as a permanent fixed image under the action of heat and pressure, and then discharges the recording material P. The image bearing member 1 after separation of the recording material P is wiped by a cleaning blade 6*a* of a cleaner 6 so that residual attachments such as transfer residual toner is removed. In addition, the image bearing member 1 is further discharged by being subjected to entire surface exposure by means of a pre-exposure device 7, so that it can be used for image formation in a repeated manner.

Numeral 9 denotes a control circuit part (control unit). This control circuit part 9 controls processing of signals input from a variety of process equipment of the image forming apparatus, and command signals to the variety of process equipment, as well as prescribed imaging sequence processing. The apparatus is controlled according to control programs and reference tables stored in a ROM.

Numeral 10 is an operation panel. Various image formation conditions are input from this operation panel 10 to the control circuit part 9. In addition, various information is input from the control circuit part 9 to the operation panel 10 and is displayed on a display part.

(2) Methods for Measuring the Electrostatic Capacitance (C/S), the Relative Dielectric Constant ∈[m], and the Film Thickness d[m] of the Image Bearing Member Reference will be made to a method for measuring the electrostatic capacitance (C/S) of the image bearing member used in the present study. A planar exposure plate having a layer construction similar to that of an actual photosensitive layer (including a charge generation layer, an electric charge blocking layer, and a surface layer) formed on a metal substrate was prepared, and electrodes being smaller than the exposure plate was placed into contact with the exposure plate. An amount of charge q accumulated in the photosensitive layer was obtained by monitoring a current flowing through the electrodes when each DC voltage, 200V, 400V, 600V, 800V, or 1000V, was applied on the electrodes, and integrating a current curve obtained with respect to time.

By performing this with the value of the DC voltage being varied, the electrostatic capacitance (C) of the exposure plate was obtained from the amount of charge q and the slope of the voltage value V. At this time, the electrostatic capacitance (C/S) per unit area was obtained from the area (S) of the electrodes used.

Next, reference will be made to a method for measuring the film thickness dm and the relative dielectric constant ∈m of the image bearing member used in the present study. The film thickness dm of the photosensitive layer was obtained by measuring the thickness of the photosensitive plate before and after formation of the photosensitive layer thereon by means of a film thickness meter, and calculating a difference between the measurements. In addition, the relative dielectric constant cm was obtained by assigning the values thus obtained to the electrostatic capacitance (C/S) and the film thickness (dm) in the following theoretical equation: $\in m=(C\cdot dm)/(S\cdot \in_0)$).

(3) Method for Measuring a Charging Efficiency

Now, reference will be made to a "charging efficiency" introduced in the following verification for numeric conversion of the level of defective charging. The charging efficiency is a ratio of charging potential ΔV with respect to a development contrast Vcont as shown in Equation 3. Here, the development contrast Vcont is a potential difference between a DC component of the developing bias and a bright potential $V_L$ of that portion of the image bearing member which is to be formed into an image part.

ΔV denotes a potential difference between a surface potential of a toner layer after a latent image potential part has been developed and a latent image potential before development. That is, ΔV of a portion of the image bearing member corresponding to a solid image portion is a potential difference between a toner layer surface potential after development of a bright potential portion, which is a portion of the image bearing member corresponding to the solid image portion, and a bright potential before development of the portion of the image bearing member corresponding to the solid image portion. The potentials such as the bright potential, the toner layer potential, etc., were measured at or in the vicinity of the position of development by means of a surface potential meter. The surface potential meter used for measurement is MODEL 347 manufactured by TREC INC.

$$\text{Charging efficiency}=\text{Charging potential } \Delta V/\text{Developing contrast}\times 100 \qquad \text{Equation 3}$$

Reference will be made to a method for measuring the charging efficiency.

First of all, an empty developing device 4 with no two-component developer A contained therein was prepared, and a surface potential (latent image potential before development) on the image bearing member 1, which has not been developed by toner, after charging and formation of a latent image, is measured by means of a surface potential meter 12 which is arranged right under the developing device.

Then, the developing device 4 containing the two-component the developer A therein is prepared, and a toner image is actually formed on the image bearing member 1 by applying a developing bias thereon after charging and formation of a latent image. The potential on the surface of the image bearing member immediately after development (latent image potential after development) is similarly measured by the surface potential meter 12.

Figure 17:
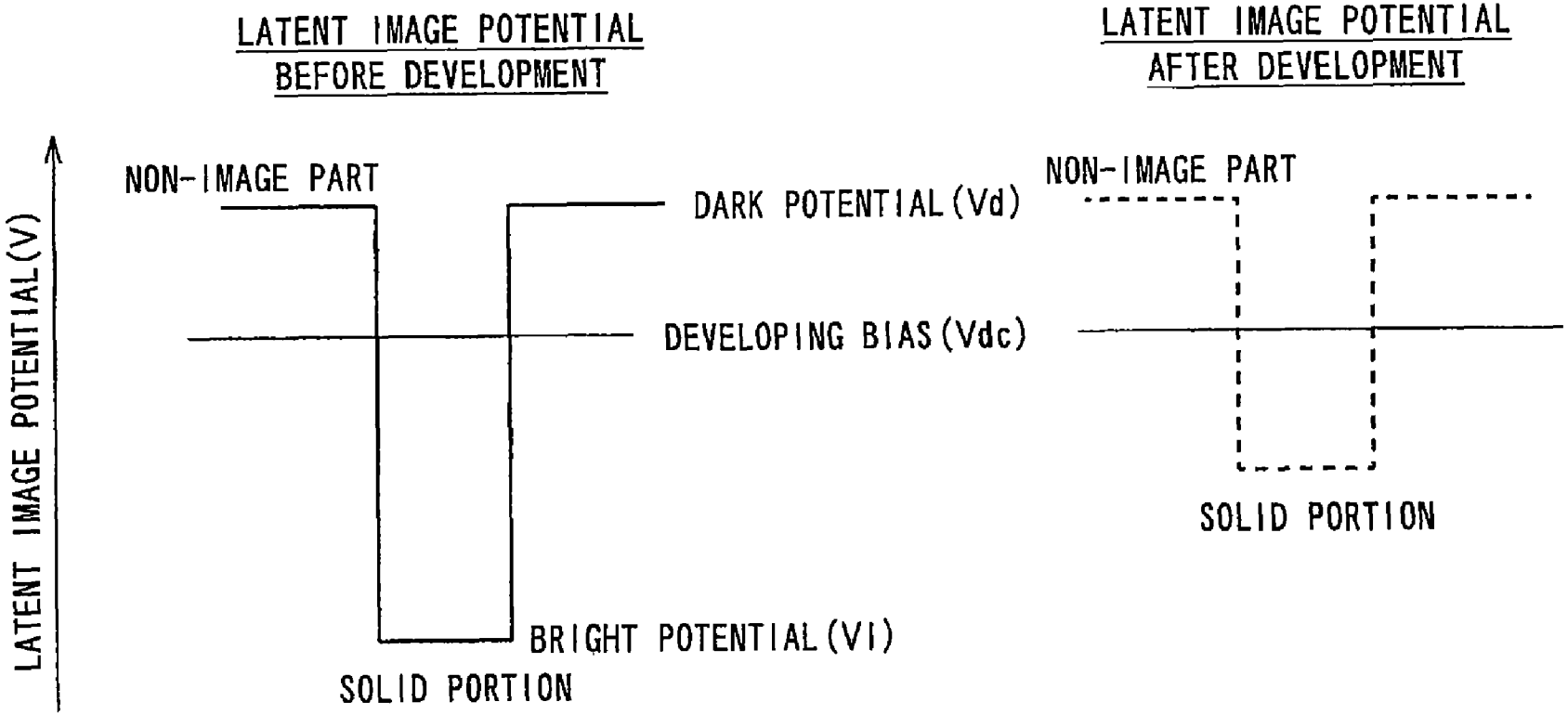
FIG. 17 is a view illustrating a latent image potential obtained by means of a surface potential meter before and after development.
Figure 18:
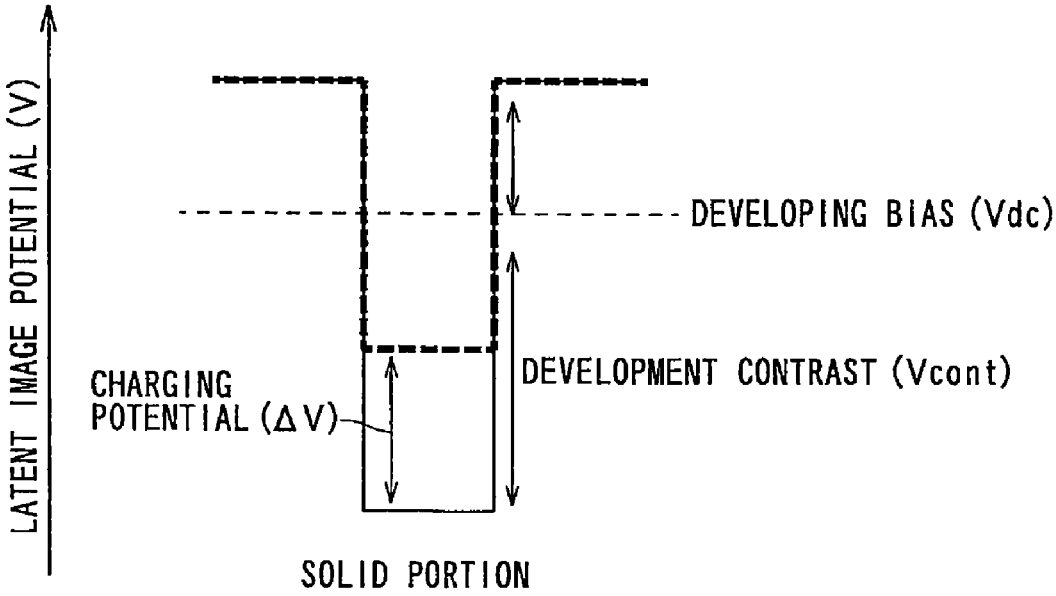
FIG. 18 is a view illustrating a charging potential after development.

FIG. 17 illustrates the potential profiles of the latent image potentials before and after development obtained by the above-mentioned two methods. The potential difference ΔV created by the actual development of the toner can be obtained by subtracting the surface potential value of the latent image potential before development from the surface potential value of the latent image potential after development. The ratio of ΔV to Vcont at this time is the charging efficiency (see Equation 3).

Of course, Vcont is decided at the position of development. Specifically, a dedicated surface potential meter is arranged at the position of the developing device 4, and the potential of the latent image at the position of development is measured, whereby Vdc is decided with respect to the latent image potential, thus ensuring Vcont at the position of development.

Figure 19:
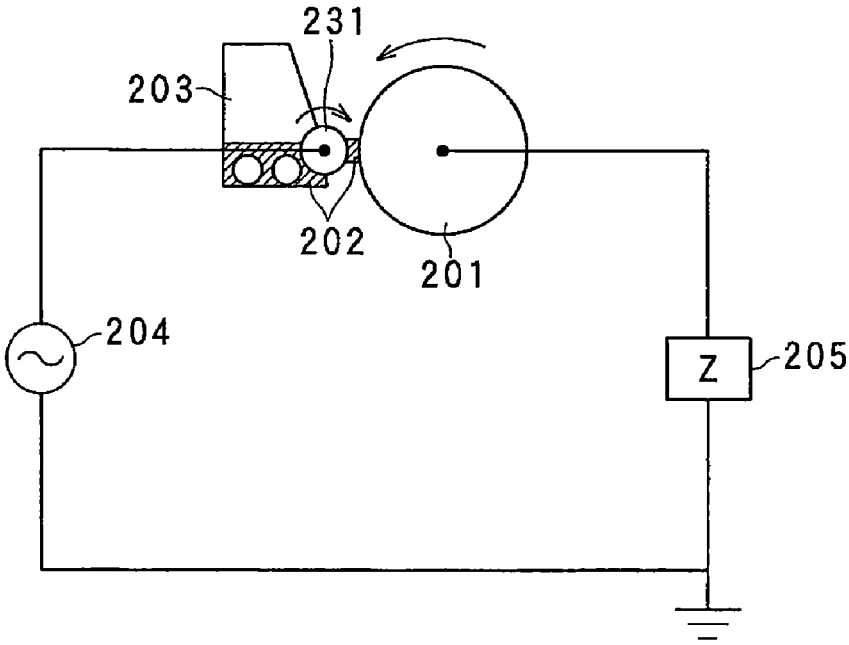
FIG. 19 is a schematic diagram of a device used to detect the resistivity ρ (Ω·cm) and the relative dielectric constant ∈ of the magnetic carrier.

(4) Method for Measuring the Resistivity ρ and the Relative Dielectric Constant ∈ of the Magnetic Carrier Reference will be made to a method for measuring the resistivity ρ and the relative dielectric constant ∈ of the magnetic carrier. FIG. 19 is a schematic diagram of a device used for the measurements. This device is modified machine of a model IRC-6800 which is a form of composite copying machine manufactured by Canon Inc. The photoconductive drum of the composite copying machine is replaced to the aluminum cylindrical body 201 (hereinafter referred to as an Al drum) of ϕ84 mm in diameter without a photosensitive layer and is made to be capable of driving in the direction of rotate Al drum is rotated at a peripheral speed of 286 mm/sec. And in the developing device 203 of the modified machine, the magnetic carrier 202 of measurement is filled up in pure form. Then the ϕ 20 mm developing sleeve 231 which supported the magnetic carrier 202 is made to counter the AL drum. Under the present circumstances, the developing sleeve 231 rotates so that it may move in the same direction as Al drum in an opposite portion with Al drum, and that peripheral speed is 500 mm/sec. In addition, the Al drum and the developing sleeve are positioned so that a 300-micrometer cavity (SD gap) may be formed in the opposite portion.

Then, on the above-mentioned conditions an AC voltage (sine wave) from which a pressure value differs mutually is applied each between the AI drum 201 and the developing sleeve 231 by means of a power supply 204 (HVA4321 manufactured by NF Company) while rotating the Al drum 201 and the developing sleeve 231 at the predetermined peripheral speed. At this time, the plural AC voltage values are set up suitably within the limits from which the electric-field boundary two or more of these pressure values want to investigate the electric-field dependency of the impedance of a container is acquired. At this time, impedance can be measured by measuring a response current to the applied voltage and sweeping the frequency of the sine wave from 1 Hz to 10 kHz.

In the present invention, sweeping the frequency of the sine wave and measurements of impedance were made automatically by the use of a dielectric measurement system 205 (126096W) manufactured by Solartron Metrology, a British company.

An analysis method will be described. An equivalent circuit is derived from a Cole-Cole plot that plots individual measurements (Re(Z), Ima(Z)) obtained by sweeping the frequency from 1 Hz to 10 kHz (see FIG. 20).

Figure 20:
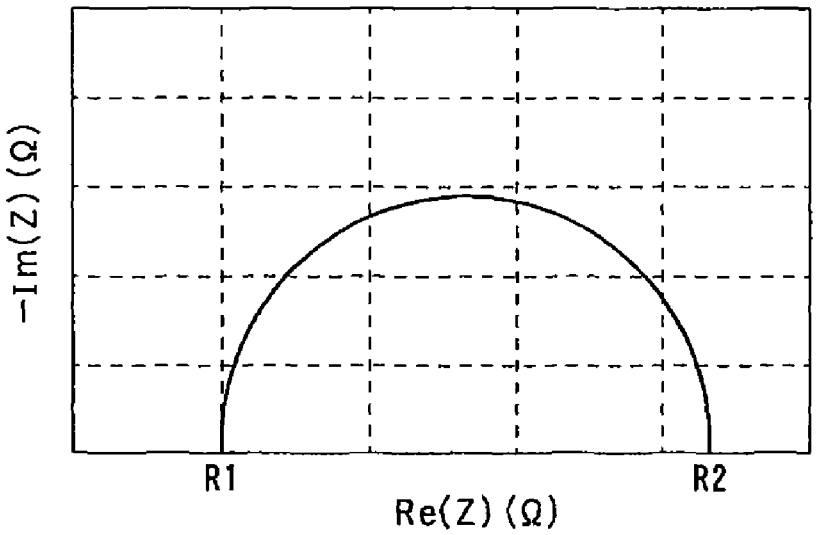
FIG. 20 is a view illustrating Cole-Cole plots obtained by measurements.

From this, it is suggested that the equivalent circuit of the magnetic carrier be a parallel circuit when the Cole-Cole plot is a semicircle as shown in FIG. 20. An R component and a C component of the magnetic carrier can be obtained by performing fitting on the RC parallel circuit according to analytical software (Zview) manufactured by above Solartron Metrology.

Here, note that an electrostatic capacitance Ct obtained according to the above-mentioned analysis method includes an influence due to an air layer (relative dielectric constant of 1) outside the development region (hereinafter referred to as a development nip) in the developing sleeve 231 and the Al drum 201. In other words, to obtain the electrostatic capacitance C of the magnetic carrier 202, it is necessary to subtract an electrostatic capacitance Ca due to the air layer outside the development nip from the electrostatic capacitance Ct obtained according to the above-mentioned analysis method.

Reference will be made to a method for deriving the electrostatic capacitance Ca. The empty developing device 203 containing no magnetic carrier 202 therein is measured by the above-mentioned measuring method. An electrostatic capacitance Cat obtained according to the above-mentioned analysis method is a combined value of an electrostatic capacitance Can due to an air layer inside the development nip and the electrostatic capacitance Ca due to the air space outside the development nip. The electrostatic capacitance Can can be obtained from the relative dielectric constant ($\in$=1) of the air layer, the SD gap (cm), and a contact area ($cm^2$) of the magnetic carrier with respect to the Al drum 1. Ca can be derived from Cat and Can thus obtained (i.e., Ca=Cat−Can). Finally, the electrostatic capacitance C of the magnetic carrier is decided as follows: C=Ct−Ca.

The resistivity ρ(Ω·cm) and the relative dielectric constant $\in$ of the magnetic carrier 202 for the resistance R and the electrostatic capacitance C of the magnetic carrier 202 obtained by the above-mentioned analysis method were obtained from the SD gap (cm) and the contact area ($cm^2$) of the magnetic carrier 202 with respect to the Al drum 201, respectively.

Here, note that the relative dielectric constant $\in$ and the resistivity ρ of the magnetic carrier in the appended claims of this application use the values obtained according to the above-mentioned measuring method. In other words, the relative dielectric constant $\in$ and the resistivity ρ of the magnetic carrier used in the appended claims of this application are not the values of the physical properties of the single magnetic carrier, but represent the relative dielectric constant $\in$ and the resistivity ρ including the magnetic carrier and the air layer lying in the development nip.

In addition, the resistivity ρ and the relative dielectric constant $\in$ obtained by the above-mentioned measuring method do not take the toner into consideration. The individual physical property values of the two-component developer actually mixed with the toner can be expected to be different from those obtained according to the above method. However, it is considered that the influence of the toner on the individual physical property values in the development nip is limited because under the application of the developing bias, the toner is continuously moving between the magnetic carrier and the image bearing member. Accordingly, when the resistivity ρ and the dielectric constant $\in$ are specified in the present invention, the toner is not taken into consideration.

(5) Method for Measuring the Electric Field Strength Dependence of the Resistivity ρ and the Relative Dielectric Constant $\in$ of the Magnetic Carrier Reference will be made to a method for measuring the field strength dependence of the resistivity ρ and the relative dielectric constant $\in$ of the magnetic carrier. The electric field strength dependency of the resistivity ρ and the relative dielectric constant $\in$ can be measured by sweeping the amplitude of the sine wave applied by the power supply 204 of FIG. 19 as previously mentioned. At this time, the electric field strength is obtained by dividing the amplitude (V) of the in sine wave by the SD gap (cm).

Figure 21:
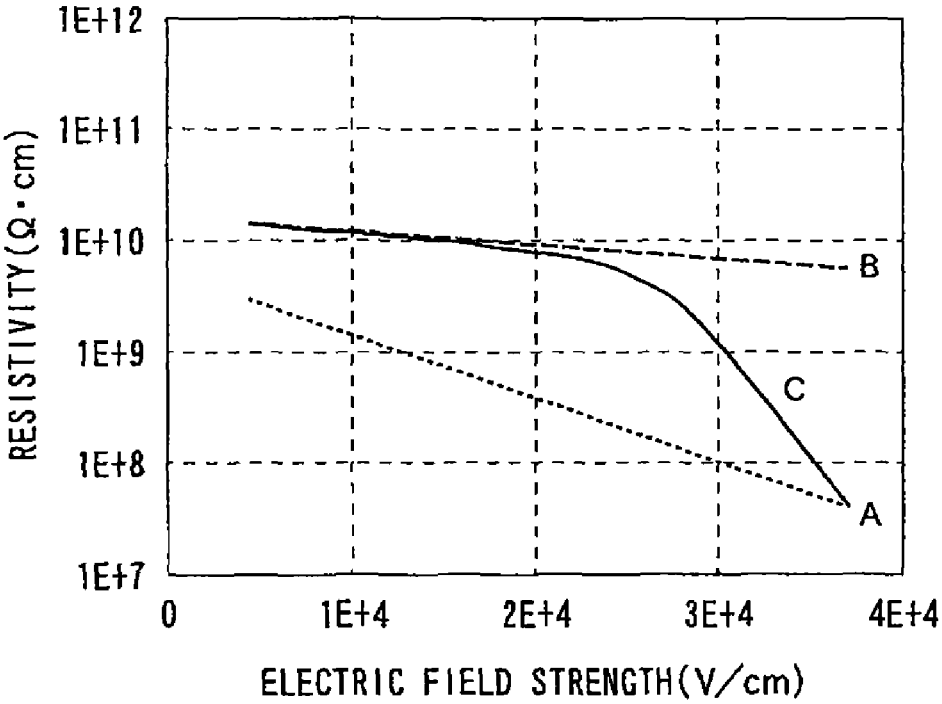
FIG. 21 is a view illustrating the relation between the electric field strengths E (V/cm) in magnetic carriers A, B, C and the resistivities ρ (Ω·cm) of the magnetic carriers used in the above examples.
Figure 22:
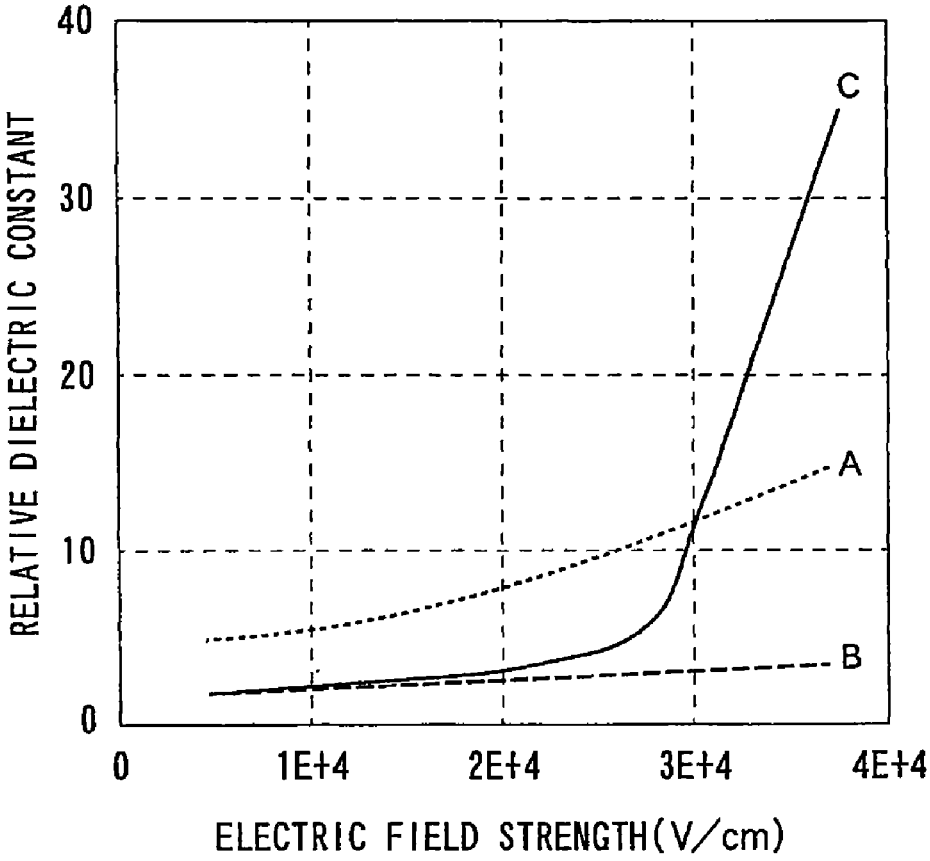
FIG. 22 is a view illustrating the relation between the electric field strengths E (V/cm) in magnetic carriers A, B, C and the relative dielectric constants ∈ of the magnetic carriers used in the above examples.

Examples of measurements are illustrated in FIG. 21 (for ρ) and in FIG. 22 (for $\in$). In these figures, A denotes a carrier of high dielectric constant used in this example; B denotes a carrier of low dielectric constant used in this example; and C denotes a carrier according to the present invention used in this example.

(6) Method for Deciding the Dielectric Field Strength Under the application of Developing Bias The electric field strength under the application of the developing bias is decided as follows.

Figure 1:
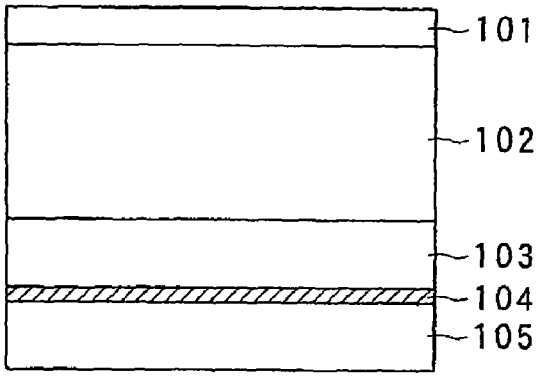
FIG. 1 is a layer construction model view of one example of an organic photoconductor.
Figure 2:
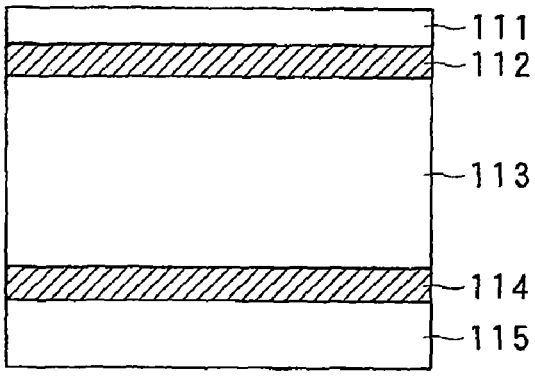
FIG. 2 is a layer construction model view of one example of an α-Si photosensitive member.
Figure 3:
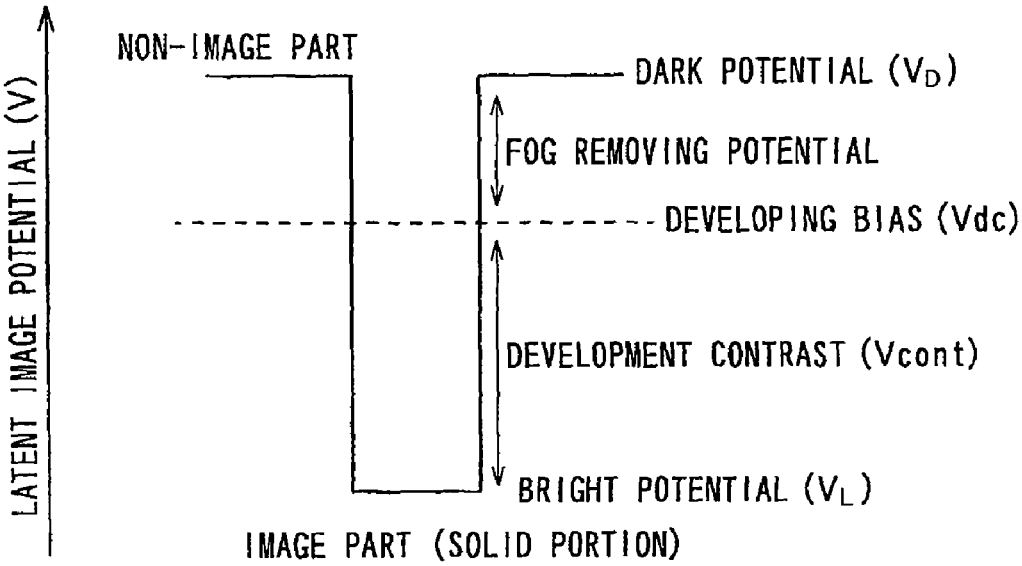
FIG. 3 is a view illustrating a latent image potential.
Figure 4:
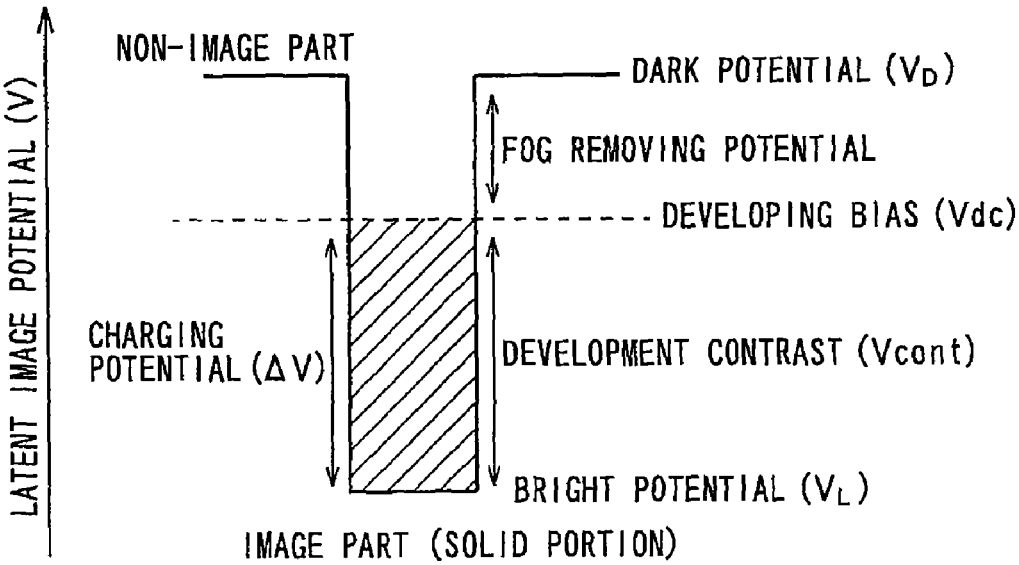
FIG. 4 is a view illustrating a latent image potential in a charged state.
Figure 5:
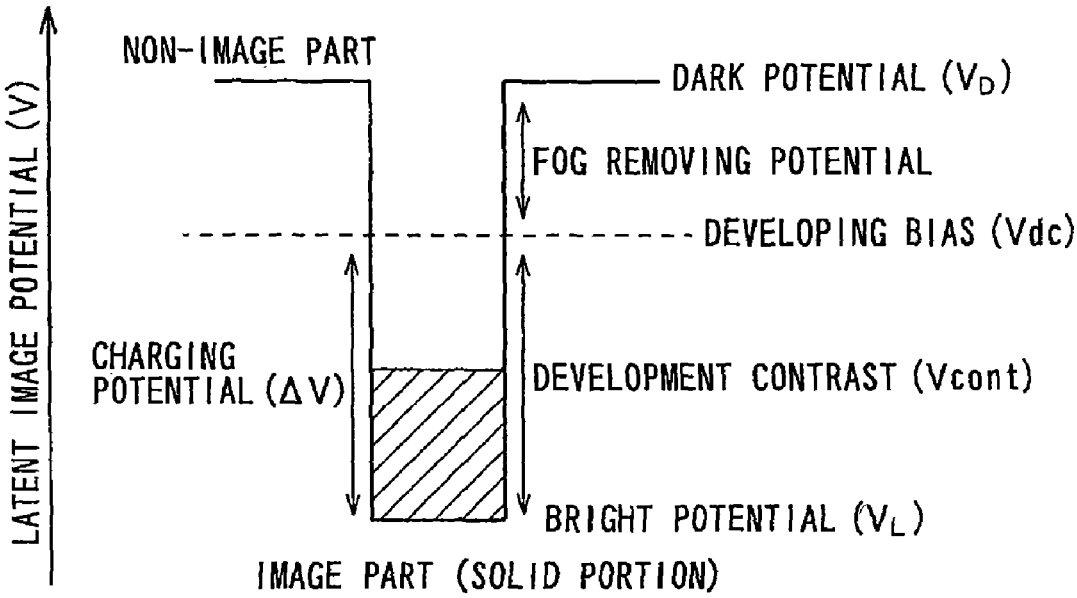
FIG. 5 is a view illustrating a latent image potential in a defective charge state.
Figure 6:
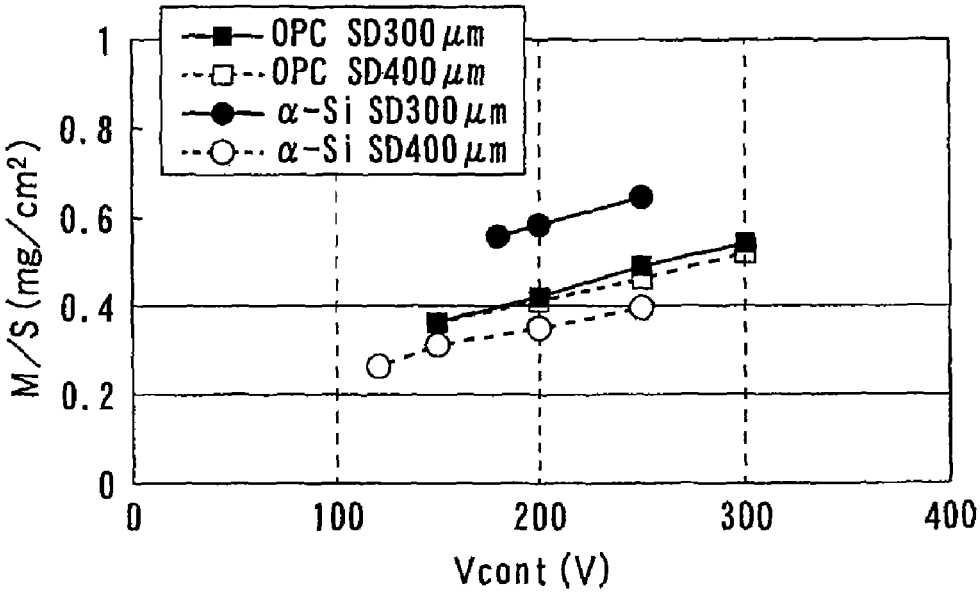
FIG. 6 is a view illustrating the relation between the amount of toner and Vcont in the variation of a SD gap.
Figure 7:
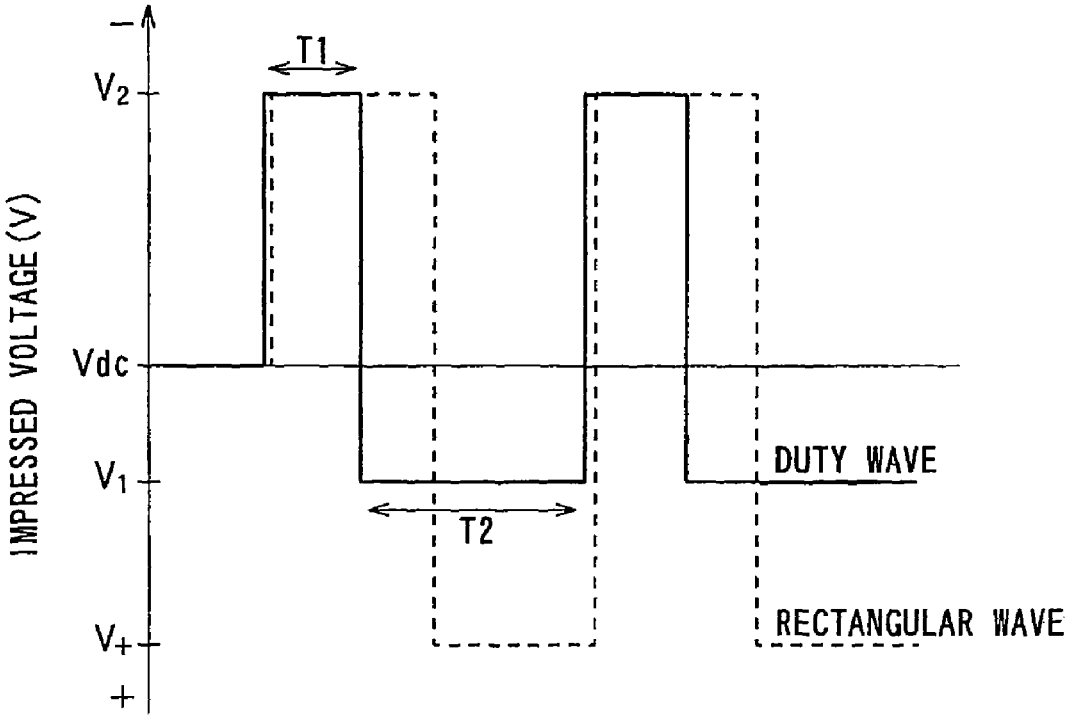
FIG. 7 is a waveform diagram illustrating a bias used in this example.

For example, in case where the developing bias is such as shown in FIG. 7, it is assumed that a phase time for moving the toner in the direction of the image bearing member is T1 and a phase time for moving the toner in the direction of the developer carrying member is T2. An electric field strength $E_{1L}$ under the action of which a force acting in the direction of the image part (bright potential $V_L$) is most strongly applied to the toner restrained by the magnetic carrier is represented by the following expression: $E_{1L}=(V_1-V_L)/(\text{SD gap})$ [V/cm]. On the other hand, an electric field strength $E_{2D}$ under the action of which a force acting in the direction of the developer carrying member is most strongly applied to the toner in the non-image part (dark potential $V_D$) on the image bearing member is represented by the following expression: $E_{2D}=(V_2-V_D)/(\text{SD gap})$ [V/cm]. The resistivity ρ and the relative dielectric constant $\in$ of the magnetic carrier under the application of the developing bias were obtained by measuring the resistivity ρ and the relative dielectric constant $\in$ in the above-mentioned field strength according to the above-mentioned measuring method (5).

EXAMPLE 1

(7) Example 1

In this first example, chargeability and fog were measured under fixed image output conditions for magnetic carriers having different values of physical properties ($\in$, ρ)

The result of verification will be described. Development was carried out according to a digital image exposure method and a reversal development method by using, as a machine to be studied, the above-mentioned modified machine of a model IRC-6800 (a form of composite copying machine manufactured by Canon Inc.).

An image bearing member used here was an α-Si photosensitive member having a film thickness dm of 30 μm, a relative dielectric constant cm of 10, and an electrostatic capacitance per unit area C/S of $3.0\times10^{-6}$ (F/m$^2$). The film thickness dm, the electrostatic capacitance per unit area C/S, and the relative dielectric constant ∈m were measured according to the above-mentioned measuring method (2).

As shown in FIG. 16, the above-mentioned image bearing member 1 was uniformly charged on its surface to a desired dark potential $V_D$ (−480V) at a developing position by means of the primary charger 2, and the potential of a solid portion was adjusted to a desired bright potential $V_L$ (−130V) at the developing position by means of the scanner 3.

The distance (SD gap) between the developing sleeve 4*c* and the image bearing member 1 was 300 μm.

The developing bias used at this time has a waveform including a DC component and an AC component which is superposed on the DC component, as shown in FIG. 7. Specifically, the developing bias is a duty wave having a frequency 5 kHz, a duty ratio of 60%, and a peak to peak voltage (hereinafter referred to as a Vpp) of 1.54 kV.

The electric field strengths $E_{1L}$, $E_{2D}$ in the pull-back direction and in the developing direction decided by the developing bias, the bright potential $V_L$, and the dark potential $V_D$ were as follows: $E_{1L}=3.7\times10^4$ [V/cm], and $E_{2D}=2.6\times10^4$ [V/cm]. Vdc, being a DC component, serves to ensure a necessary development contrast (200 V) and a necessary fog removing potential (150 V) for an electrostatic latent image on the image bearing member, i.e., the bright potential VL (−130 V) corresponding to the solid portion and the dark potential $V_D$ (−480 V). Therefore, a study was carried out by setting the DC component Vdc to −330 V (i.e., Vdc=−330 V). Here, the development contrast is a difference between the DC component Vdc and the bright potential $V_L$, and the fog removing potential is a difference between the DC component Vdc and the dark potential $V_D$.

Here, note that in this study, the frequency of the developing bias was 5 kHz, but it is preferable that the frequency be in a range of 3 kHz-8 kHz. According to the inventors' study, it has been found that when the frequency is less than 3 kHz, fog does not reach the allowable level under any condition, and when the frequency is higher than 8 kHz, chargeability does not reach the allowable level under any condition.

Next, reference will be made to a developer used in the present invention.

A two-component developer including a non-magnetic toner and a magnetic carrier was used as a developer. A toner produced according to a well-known conventional grinding method was used as a non-magnetic toner used. On the other hand, three kinds of carriers having different values of physical properties (∈, ρ) were prepared as a magnetic carrier used. Individual features of the carries will be specifically described.

High Dielectric Constant Carrier (Low Electric Resistance) A:

As a high dielectric constant (low electric resistance) carrier A, there is listed, for example, one using, as a core material, magnetite and ferrite that have magnetism and are denoted by the following formula (1) or (2).

$$MO.Fe_2O_3 \quad (1)$$

$$M.Fe_2O_4 \quad (2)$$

where M denotes a trivalent, divalent, or univalent metal ion.

As M, there are listed Be, Mg, Ca, Rb, Sr, V, Cr, Mn, Fe, Co, Ni, Cu, Zn, Y, and Zr, Nb, Mo, Cd, Pb, and Li, which can be used singularly or in combinations.

As specific compounds of the above-mentioned metallic compound particles having magnetism, there are listed, for example, ferrous oxides such as Cu—Zn—Fe-based ferrite, Mn—Mg—Fe-based ferrite, Mn—Mg—Sr—Fe-based ferrite, Li—Fe-based ferrite and so on.

Any well-known methods can be adopted as a method for producing ferrite particles. For example, there can be listed the following methods.

That is, a ferrite composition crushed to submicrometer size is mixed with a binder, water, a dispersing agent and so on, and is then formed into particles by the use of a spray dryer process or a flow granulation process.

Thereafter, the particles thus formed are baked at a temperature in the range of 700-1,400 degrees C., preferably 800-1,300 degrees C., in a rotary kiln or a batch kiln. Subsequently, the baked particles are sieve classified so as to control the particle size distribution thereof in an appropriate manner, whereby core material particles for the carrier are provided.

In addition, the surface of each ferrite particle is coated with a silicone resin or like other material at a level of about 0.1-1.0 mass %. Here, the magnetic carrier prepared in this manner is called the high dielectric constant carrier A.

Low Dielectric Constant (High Electric Resistance) Carrier B:

As a low dielectric constant carrier B, there are listed, for example, the following ones.

A first one uses, as a core material, a magnetic material dispersed resin carrier that is produced by melting, mixing, and crushing magnetite particles and a thermoplastic resin.

A second one uses, as a core material, a magnetic material dispersed resin carrier that is produced by spray-drying a slurry, which is formed by melting and dispersing magnetite particles and a thermoplastic resin in a solvent, by means of a spray dryer or the like.

A third one uses, as a core material, a magnetic material dispersed resin carrier that is produced by reaction-hardening phenol through direct polymerization under the presence of magnetite particles and hematite particles.

In addition, these carrier core materials thus produced are further coated with a resin such as a thermoplastic resin, etc., at a level of about 1.0-4.0 mass % by means of a fluidized bed coating device or the like. Here, the magnetic carriers produced in these manners are called the low dielectric constant carrier B.

Carrier C According to the Present Invention:

On the other hand, as the carrier C according to the present invention, there can be used, for example, a porous resin-filled carrier which is produced by pouring a resin such as a silicone resin into a porous core to fill pores or voids therein.

As a method for producing the carrier C, there can be listed the following methods.

First, iron (ferric or ferrous) oxide ($Fe_2O_3$) and one or two or more kinds of metal oxides chosen from a group comprising Ni, Cu, Zn, Li, Mg, Mn, Sr, Ca and Ba, as used in the above-mentioned high dielectric constant carrier A, are weighed in predetermined amounts, respectively, and are mixed with one another.

Then, the mixture thus obtained is calcinated at a temperature in the range of 700-1,000 degrees C. for period of 5 hours, and is thereafter crushed into particles having a particle size of about 0.3-3 μm. A binder, water, and a dispersing agent, together with organic particulates and a pore or void forming agent such as $Na_2CO_3$ as necessary, are added to the crushed mixture thus obtained, which is then spray-dried by a spray dryer under a heating atmosphere in the temperature range of 100-200 degrees C. to form granules having a size in the range of about 20-50 μm.

Thereafter, the granules thus obtained are baked or sintered in an atmosphere of an inert gas (e.g., N2 gas, etc.) having an oxygen concentration of 5% or less at a sintering temperature in the range of 800-1,400 degrees C. for a period of 8-12 hours. As a result, a porous core is obtained. Subsequently, a silicone resin is filled into the porous core at a level of 8-15 mass % in a decompressed state by means of a dipping process, and then the silicone resin thus filled is solidified under an inert gas atmosphere at a temperature in the range of 180-220 degrees C. In addition, in case of need, the porous core thus filled with the silicone resin is further coated with a resin such as a thermosetting resin at a level of about 0.1-5.0 mass % by means of the dipping process.

In the above-mentioned production method, the relative dielectric constant ∈ and the resistivity ρ of the carrier can be controlled by controlling the porous degree (porosity) of the core and the resistance of the core material as well as the amount of resin such as silicone resin to be filled, the amount of resin of the coating resin, and so on.

Next, in the image forming apparatus using such a carrier, the studying result which inventors performed in order to improve charge nature and fog is shown below.

First, as an effective measure in order to improve a charging rate, a method of controlling the movement of toner by means of a developing bias that is generated by an oscillating voltage was discussed. Specifically, as shown in FIG. 7, a phase time for which electrostatic force to move the toner in a first direction toward the image bearing member from the developer carrying member is caused for one period is denoted as T1, and a peak voltage in the phase time T1 is denoted as a first peak voltage $V_1$. In addition, a phase time for which electrostatic force to move the toner in a second direction toward the developer carrying member from the image bearing member is caused is denoted as T2, and a peak voltage in the phase time T2 is denoted as a second peak voltage $V_2$ in a pull-back direction. The first and second peak voltages $V_1$, $V_2$ are applied in an alternate manner. At that time, the proportion of T2 in one period (hereinafter referred to as a duty ratio) is raised or increased while keeping a DC component Vdc of the developing bias and the peak voltage $V_1$ in the developing direction at certain voltage values, respectively. In this case, the value of V1 and V2 and the rate of T1 and T2 are determined so that the integration value which was integrated the waveform in T1 and the integration value which was integrated the waveform in T2 with reference axis to Vdc may become the same value. As a result, an oscillating bias (hereinafter referred to as a duty wave) is produced which serves to weaken the peak voltage $V_2$ in the pull-back direction. Here, note that the duty ratio (Du) (%) is calculated according to a relational expression of (T2/(T1+T2))×100.

The prevent such duty wave serves to weaken a pull-back force which acts to pull back the toner in the direction of the developer carrying member in the phase time T2, so the toner is localized in the vicinity of the image bearing member. As a result, the amount of the toner to be finally developed on the image bearing member increases, and hence defective charging can be improved.

Figure 8:
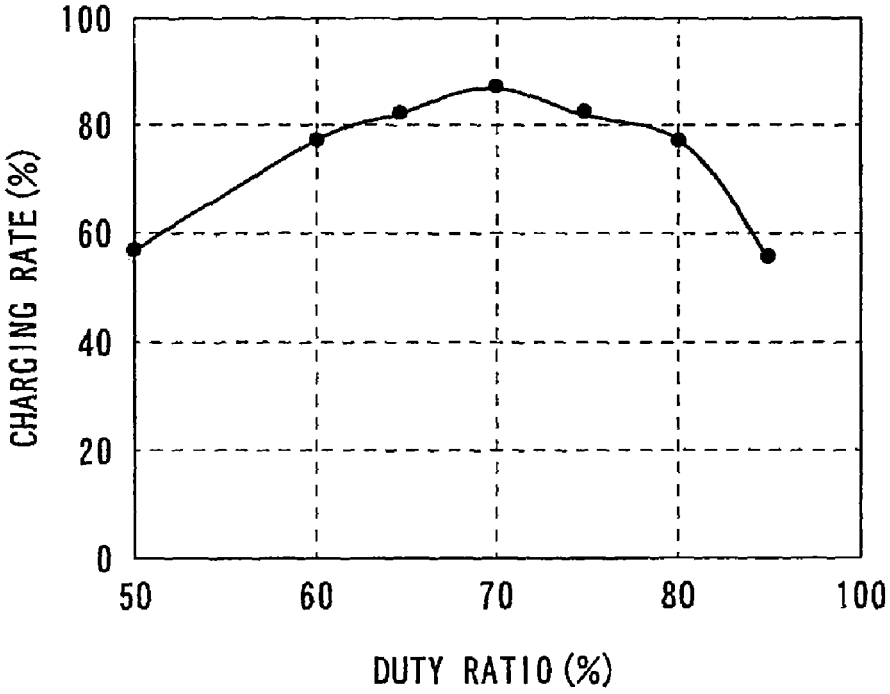
FIG. 8 is a view illustrating the relation between the duty ratio of a duty wave and a charging rate.
Figure 12:
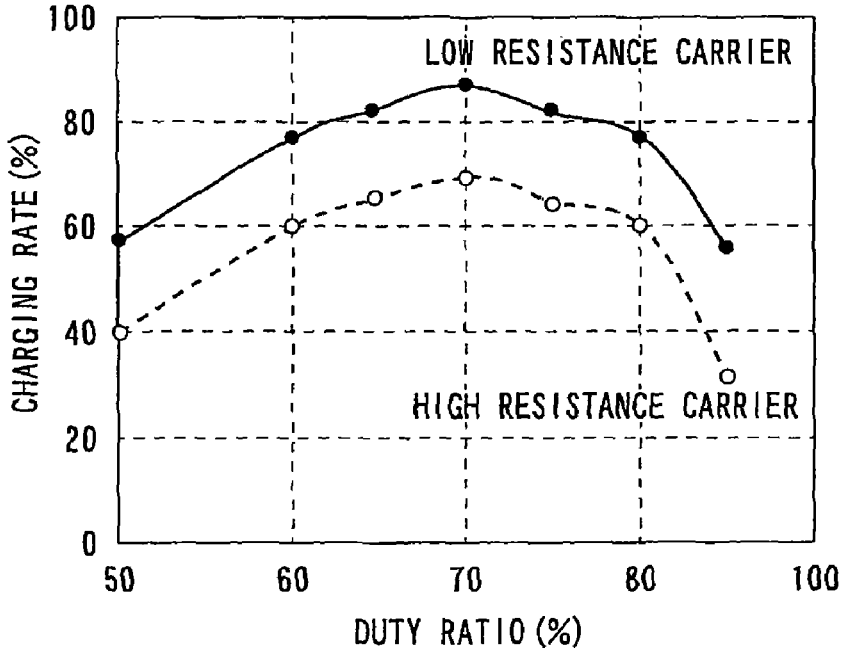
FIG. 12 is a view illustrating the relation between the duty ratio of a duty wave and a charging rate.

FIG. 8 is a view illustrating the change in the chargeability when the duty ratio Du of the above-mentioned duty wave is varied using the carrier A. For the above reason, as the duty ratio Du is raised or increased, the chargeability is improved to a remarkable extent as compared with a rectangular wave (a duty ratio of 50%) denoted by a dotted line in FIG. 8. However, when the duty ratio exceeds 80%, the phase time for which the toner is caused to move in the direction toward the developer carrying member becomes too long with respect to the time for which the toner is caused to move in the direction of the image bearing member, as a result of which the toner can not be moved in the direction of the image bearing member, and the chargeability is decreased to a great extent. In addition, about these characteristics, as shown in FIG. 12, even if it changed and studied the type of carrier, the result of the same tendency is obtained.

According to the result of the study by the inventors, it has been found that when the duty ratio Du is in the range from 60% to 80%, a sufficient advantage can be obtained without regard to the types of the carrier and the frequency of the developing bias in comparison with the rectangular wave.

Meanwhile, if the peak voltage V2 is weakened as shown in the duty wave, the adhesion of the toner to a non-image part (hereinafter referred to as a fog) will of course be deteriorated. In addition, according to the study of the inventors, it has also been found that an image bearing member of high electrostatic capacitance is liable to deteriorate the fog because the weakly charged toner becomes liable to be adhered to the non-image part by a strong mirroring force in comparison with an image bearing member of low electrostatic capacitance.

Figure 9:
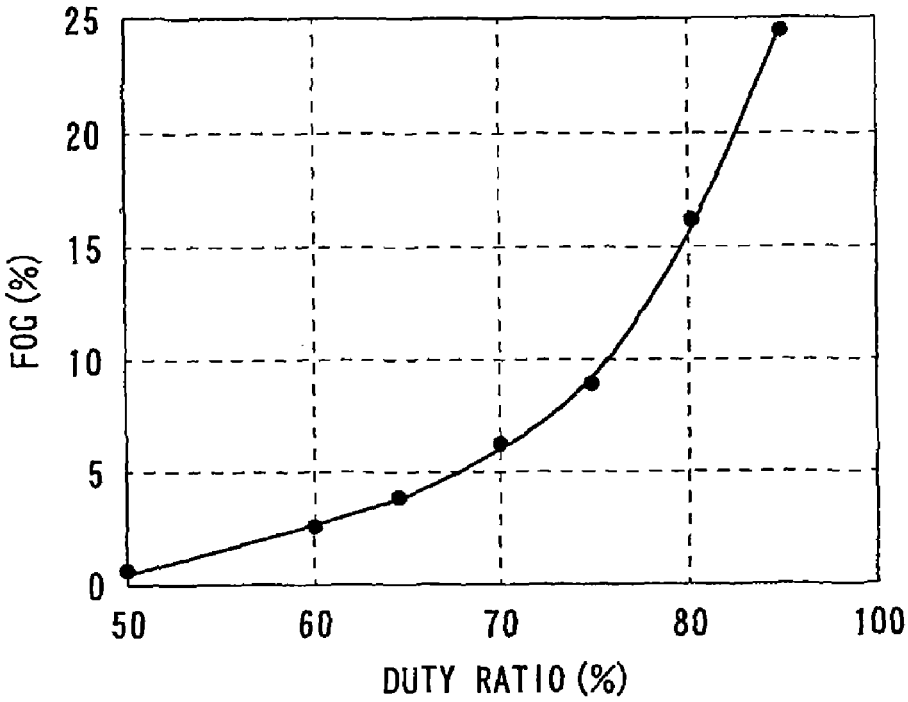
FIG. 9 is a view illustrating the relation between the duty ratio of the duty wave and a fog.

FIG. 9 is a view illustrating the change in the fog with respect to the image forming apparatus using carrier A and comprising the α-Si photosensitive member when the duty ratio Du of the duty wave is varied.

It was found that the fog is deteriorated dramatically in accordance with the raising or increasing duty ratio Du, as illustrated in this figure. Here, the following method was used for converting the fog into numeric values. The reflection density Ds of a white ground portion (non-image part) of an image was measured by means of a reflection densitometer (SERISE 1200) manufactured by GretagMacbeth. On the other hand, the reflection density Dr of paper itself was similarly measured, and the density of the fog was defined as fog density (%)=Dr−Ds.

As described above, for the image bearing member of high electrostatic capacitance, defective charging was remarkably improved by the duty wave, which, however, was not compatible with improvements in the fog only by the duty wave.

Accordingly, the inventors have studied further various schemes for improving a fog when a duty wave to be expected to improve the charging rate is used. As the most effective among such schemes, there is especially a method for increasing the resistance of a magnetic carrier to be used to higher values.

Figure 10:
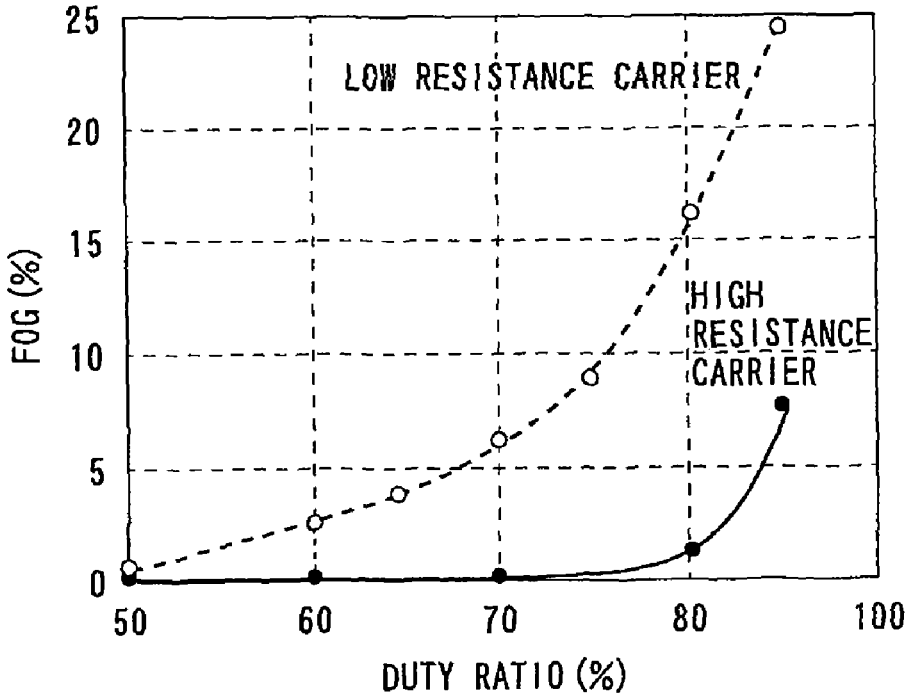
FIG. 10 is a view illustrating the relation between the duty ratio of the duty wave and a fog.

FIG. 10 illustrates the relation between a fog and a duty ratio Du when the electric resistance of a magnetic carrier to be used is varied with respect to an α-Si photosensitive member. In FIG. 10, a low resistance carrier is the above-mentioned carrier A, and a high resistance carrier is the above-mentioned carrier B. It is discovered that the fog can be drastically improved by increasing the electric resistance of the magnetic carrier to higher values, as shown in FIG. 10.

The reason why the fog can be improved is considered as follows.

The magnetic carrier can be generally considered to be an RC parallel circuit comprising a resistance component R and a capacitance component C. The magnetic carrier is charged or electrified by friction with the tone, whereby an electric charge Qc (hereinafter a counter charge) having a polarity opposite to that of the toner charge is stored in the capacitance component of the magnetic carrier. At this time, it is considered that the counter charge decays at a time constant of $\in\rho$, as shown in Equation 2.

$$Qc(t)=Q_0\exp(-t/\in_0\in\rho) \quad \text{Equation 2}$$

where Q0 denotes an initial counter charge.

According to the study of the inventors, it has been verified that the fog has a correlation to the product of a time constant $\in_0\in\rho$ (s) of electric charge decay, which is denoted by a relative dielectric constant $\in$ and a resistivity $\rho$ of the magnetic carrier in a field strength $E_{2D}$ in a phase in which the toner is caused to move to the developer carrying member, and the field strength $E_{2D}$.

Figure 11:
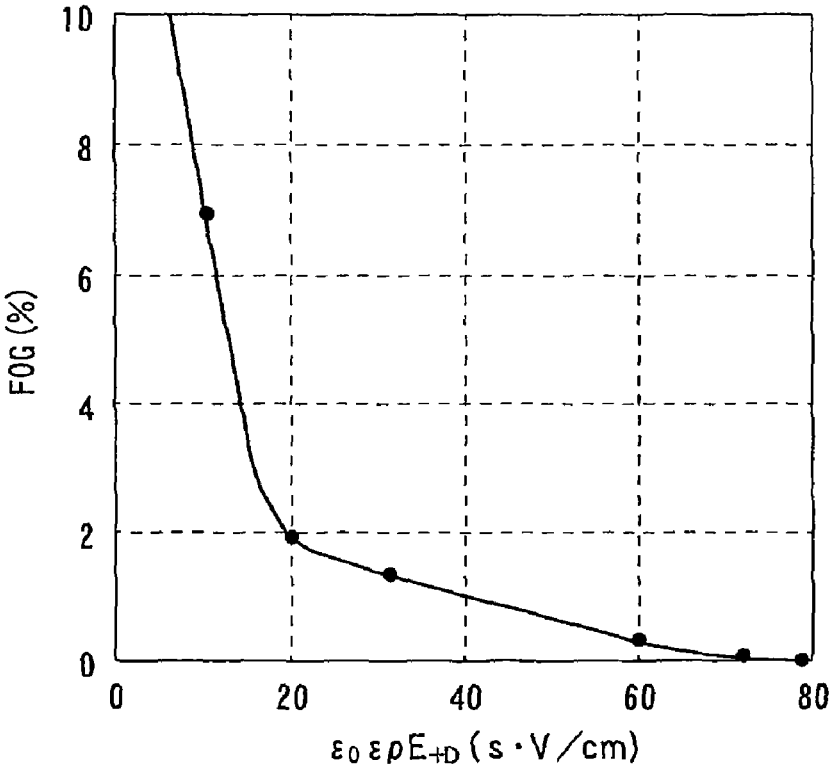
FIG. 11 is a view illustrating the relation between $\in_0 \in \rho E_{2D}$ (s·V/cm) and a fog.

FIG. 11 illustrates the fog with respect to $\in_0\in\rho\ E_{2D}$ (s·V/cm). As shown in FIG. 11, it has been verified that the fog is improved in accordance with an increase of $\in_0\in\rho\ E_{2D}$ and the fog reaches an allowable level (2% or less) when $20\leqq\in_0\in\rho\ E_{2D}$ (s·V/cm). In addition, since the larger a value of $\in_0\in\rho\ E_{2D}$ is, the better the fog is improved, in the viewpoint of prevention of the fog, there is no upper limit for the value of $\in_0\in\rho\ E_{2D}$.

The reason for this is considered as follows.

The counter charge required to collect the weakly charged fog toner with the magnetic carrier adhered to the non-image part is assumed to be q. At this time, a period of time t (hereinafter simply referred to as time t) for which the magnetic carrier has an electric charge of q or more is obtained from Equation 2 above.

$$t=-\in_0\in\rho\log(q'),$$

where $q'=q/Q_0$.

It is considered that the level of the fog results from the time t and the field strength $E_{2D}$ that acts to cause the toner to move in a direction to the developer carrying member. Thus, it is considered that the fog and $\in_0\in\rho\ E_{2D}$ are in correlation with each other for the above reason.

The reason why the fog is improved by setting the resistance ($\rho$) of the magnetic carrier to a high value is considered as follows. That is, $\in_0\in\rho$ of the magnetic carrier is increased to lengthen the time for which the magnetic carrier holds a necessary amount of counter charge. The weakly charged fog toner adhered to the non-image part is collected by the remaining counter charge, whereby the fog is improved.

However, according to the study of the inventors, it is discovered that the chargeability is deteriorated only by setting the electric resistance of the magnetic carrier to high values in order to improve the fog. FIG. 12 illustrates the relation between the chargeability and the duty ratio with the electric resistance of the magnetic carrier being varied. The chargeability is deteriorated by setting the electric resistance of the magnetic carrier to high values, as shown in FIG. 12.

Figure 13:
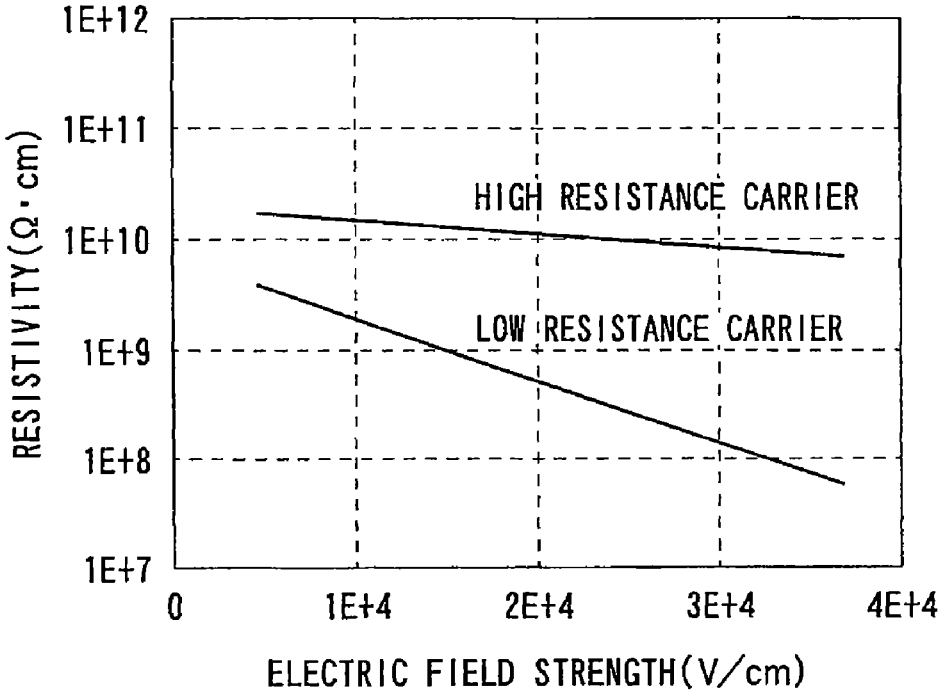
FIG. 13 is a view illustrating the relation between an electric field strength E (V/cm) and the resistivity ρ(Ω·cm) of a magnetic carrier.

FIG. 13 illustrates the electric field strength dependence of the resistivity in a high resistance carrier and a low resistance carrier used above. The resistivity decreases in accordance with the increasing electric field strength.

Figure 14:
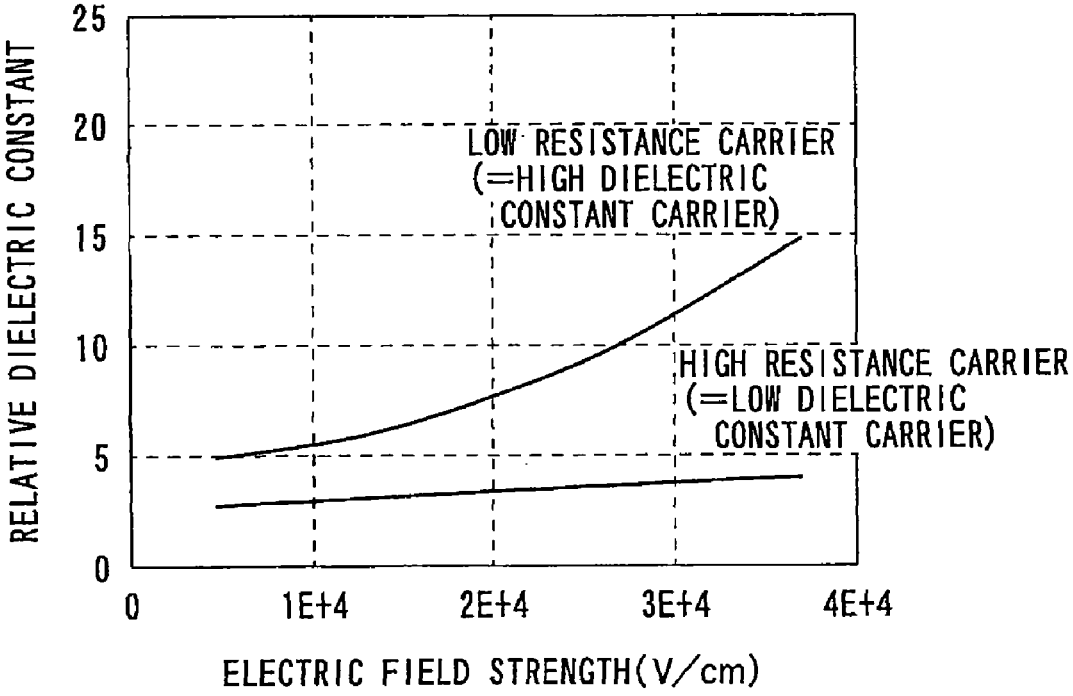
FIG. 14 is a view illustrating the relation between the electric field strength E (V/cm) and the relative dielectric constant ∈ of the magnetic carrier.

On the other hand, FIG. 14 illustrates the field strength dependence of the relative dielectric constant in these magnetic carriers. In general, in case where the electric resistance of the magnetic carrier is made higher, the relative dielectric constant of the magnetic carrier decreases in accordance with the increasing electric resistance thereof.

Figure 15:
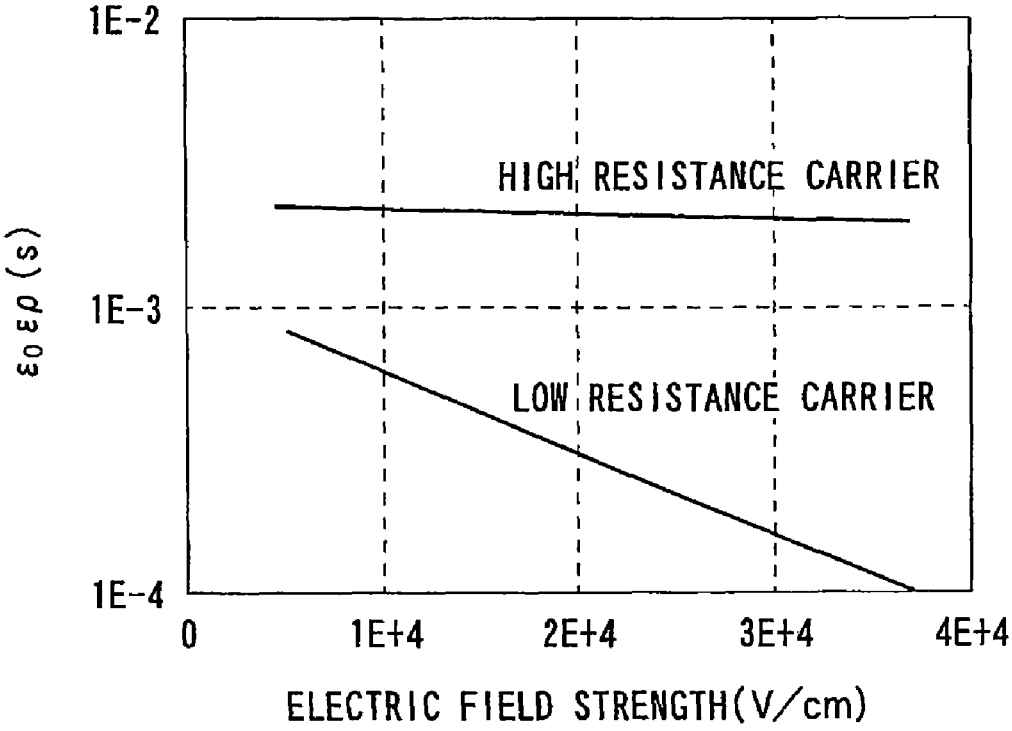
FIG. 15 is a view illustrating the relation between the electric field strength E (V/cm) and $\in_0 \in \rho(s)$ of the magnetic carrier.

FIG. 15 illustrates the relation between $\in_0\in\rho$ (s), which is obtained from the resistivity $\rho$ and the relative dielectric constant $\in$, and the field strength. The reason why the chargeability is deteriorated when the electric resistance of the magnetic carrier is made higher can be explained below according to the values of the above-mentioned physical properties.

In accordance with the increasing electric resistance of the magnetic carrier, $\in_0\in\rho$ (s) increases, so that the counter charge becomes liable to remain on the magnetic carrier. Therefore, it is considered that the toner is pulled back to the magnetic carrier by the counter charge of the magnetic carrier, thus resulting in deterioration in the chargeability.

In addition, according to the study of the inventors, it has been verified that the relative dielectric constant of the magnetic carrier itself exerts an influence on the chargeability. Specifically, the chargeability of a magnetic carrier having a small relative dielectric constant is lower than that of a magnetic carrier having a large relative dielectric constant. This can be explained by likening a developing sleeve and an image bearing member to a pair of parallel plates.

When a voltage is applied on the parallel plates, the electric field between the parallel plates becomes uniform. On the other hand, when a dielectric substance is put between the parallel plates, the electric field around the dielectric substance between the parallel plates will be distorted greatly by the boundary condition thereof. Therefore, the electric field applied to the surroundings of the dielectric substance obtained from the equipotential surfaces increases in accordance with the increasing dielectric constant of the dielectric substance.

In other words, it is considered that when there is the magnetic carrier between the developing sleeve and the image bearing member, the larger the dielectric constant of the magnetic carrier, the larger the electric field applied to the surroundings of the magnetic carrier becomes, so the toner becomes more liable to fly easily from the magnetic carrier. On the other hand, the smaller the dielectric constant of the magnetic carrier, the toner becomes less prone to fly from the magnetic carrier, as a result of which the chargeability is deteriorated.

As stated above, it is considered that if the electric resistance of the magnetic carrier is made higher in order to repress the fog, the chargeability is deteriorated due to the influence of the counter charge and the dielectric constant of the magnetic carrier on the electric field.

Thus, it is difficult to make the improvement of fog and the improvement of chargeability in the image bearing member of high electrostatic capacitance compatible with each other due to only use the carrier A or carrier B for the image forming apparatus using duty bias.

Then, as a result of studying by the inventors, it succeeded in finding out the constitution which can aim at coexistence of the improvement of fog and the improvement of chargeability by using the carrier C and the duty bias of point described above under predetermined conditions.

FIGS. 21 and 22 illustrate the measurement results of the electric field strength dependence of the resistivities $\rho$ and the relative dielectric constants $\in$, respectively, of the high dielectric constant carrier A, the low dielectric constant carrier B and the carrier C according to the present invention.

In case of the high dielectric constant carrier A, the resistivity $\rho$ thereof was decreased and the relative dielectric constant $\in$ thereof was increased, in accordance with the increasing electric field strength. In case of the low dielectric constant carrier B, the changes of both the resistivity $\rho$ and the relative dielectric constant $\in$ thereof in accordance with the increasing electric field strength were very limited. On the other hand, in case of the carrier C according to the present invention, the rates of changes of the resistivity $\rho$ and the relative dielectric constant $\in$ thereof in accordance with the increasing electric field strength were small until near a predetermined electric field strength, i.e., an electric field strength of $2.6\times10^4$ (V/cm) in this example. However, when the electric field strength of $2.6\times10^4$ (V/cm) was exceeded, the degree of decrease (decrease rate) of the resistivity ρ became larger in accordance with the increasing field strength, so the resistivity ρ decreased rapidly, whereas the degree of increase (increase rate) of the relative dielectric constant ∈ became larger, so the relative dielectric constant ∈ increased rapidly.

Therefore, the carrier C has a characteristic that the decrease rate of the resistivity to the change of field strength in a field strength which is larger than the predetermined field strength is larger than the decrease rate of the resistivity to the change of field strength in a field strength which is smaller than the predetermined field strength. In addition, the carrier C also has a characteristic that the increase rate of the relative dielectric constant to the change of field strength in a field strength which is larger than the predetermined field strength is larger than the increase rate of the relative dielectric constant to the change of the field strength in a field strength which is smaller than the predetermined field strength.

It is considered that the above-mentioned changes of the physical property values are due to the following reasons.

For example, in case of a magnetic carrier having its core material formed of an electrically conductive material, similar to the high dielectric constant carrier A, an electrical path can be easily formed inside the magnetic carrier and between adjacent particles of the magnetic carrier upon application of a voltage. The electric physical property values (∈, ρ) are considered to change in accordance with the increasing field strength. On the other hand, in case of the carrier C according to the present invention, the core thereof has a porous structure formed of an electrically conductive material and filled with an electrically insulating resin, so the interior of the core includes the coexistence of an electrically insulating resin portion and an electrically conductive porous portion.

Here, it is considered that the flow of electric charge can be interrupted to some extent in a boundary between the electrically insulating resin portion and the electrically conductive porous portion. However, it is considered that when a limit value (in this case, a field strength of $2.6\times10^4$ (V/cm)) below which the electric charge flow can be interrupted is exceeded, a rapid change in the electric physical property values (∈, ρ) occurs due to the electrically conductive portion of the core. As stated above, the relative dielectric constant ∈ and the resistivity ρ of the magnetic carrier can be controlled by controlling the porous degree of the core and the resistance of the core material as well as the amount of resin such as silicone resin to be filled, the amount of resin of the coating resin, and so on. Also, it becomes possible to control the above-mentioned limit value.

In this example, the electric field strength $E_{2D}$ in the pull-back direction is $2.6\times10^4$ (V/cm), and it is featured that the resistivity ρ is large and the relative dielectric constant ∈ is small, up to the vicinity of this electric field strength $E_{2D}$. The electric field strength $E_{1L}$ in the developing direction is $3.7\times10^4$ [V/cm], and in a region in which the changes in the physical properties are large, the resistivity ρ decreases greatly up to the same level as that of the carrier A, and the relative dielectric constant ∈ increases rapidly to a value which greatly exceeds the relative dielectric constant of the high dielectric constant carrier A.

Two-component developers used in the present invention were adjusted in such a manner that the amount of triboelectrification of the toner contained in each developer was identical or constant. Specifically, the above-mentioned mixing ratio of the non-magnetic toner and the magnetic carrier was made variable. In actuality, the percentage by weight of the non-magnetic toner with respect to the total weight of the non-magnetic toner and the magnetic carrier was in the range of 8%-10%. In addition, at this time, the amount of triboelectrification of the toner (hereinafter referred to as Q/M) was about −50 μC/g.

Here, reference will be made to a method for measuring the Q/M used.

Figure 23:
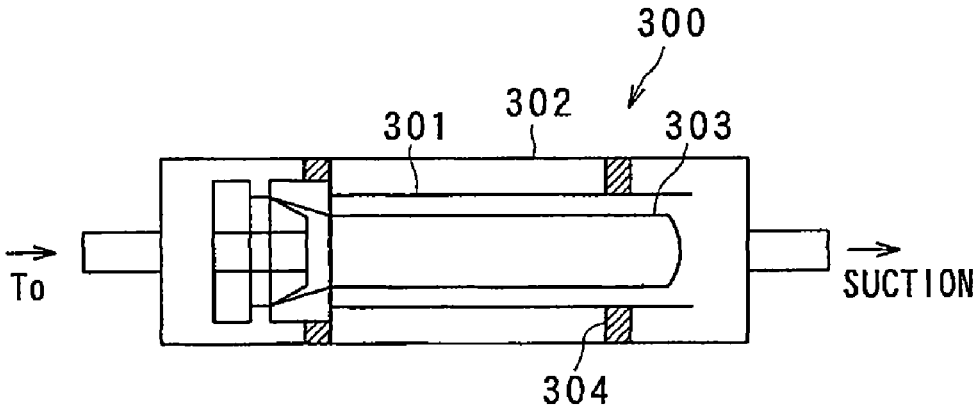
FIG. 23 is a schematic view of a Faraday gauge used in a method of measuring Q/M.

A Faraday gauge 300 illustrated in FIG. 23 is provided with a double cylinder structure including an inner metal cylinder 301 and an outer metal cylinder 302 of different diameters arranged in concentric relation with respect to each other, and a filter 303 for further taking a toner into the inner cylinder 301. The inner cylinder 301 and the outer cylinder 302 are electrically insulated by means of a pair of insulating members 304 which are arranged therebetween at axially spaced apart locations. By suction of air, the toner on the image bearing member is taken into the filter 303, whereby electrostatic induction between the inner cylinder 301 and the outer cylinder 302 electrically insulated from each other is caused by an amount of charge Q of the toner.

The amount of charge Q thus induced was measured, and the amount of charge Q measured was divided by a weight M of the toner in the inner cylinder 301 to provide a value of Q/M (μC/g). The measurements were made by the use of a measuring instrument "KEITHLEY 616 DIGITAL ELECTROMETER" manufactured by Keithley Instruments Inc.

Table 1 below illustrates the results of evaluations on individual charging rates and fogs obtained when the high dielectric constant carrier A, the low dielectric constant carrier B, and the carrier C according to the present invention were used under the above-mentioned conditions.

TABLE 1

| | $E_{2D}$ | $E_{1L}$ | | Image output result | |
|---|---|---|---|---|---|
| | $\epsilon_0\epsilon\rho E_{2D}$ | $\epsilon_0\epsilon\rho$ | ∈ | Fog | Charging rate |
| Carrier A | 8 | $1\times10^{-4}$ | 15 | D | 78% |
| Carrier B | 78 | $2.8\times10^{-3}$ | 4 | A | 60% |
| Carrier C | 60 | $2\times10^{-4}$ | 35 | A | 95% |

Here, a fog evaluation method will be described. The reflection density Ds of a white ground portion of an image part was measured by means of a reflection densitometer (SERISE 1200) manufactured by GretagMacbeth. On the other hand, the reflection density Dr of paper itself was measured similarly, and fog density was decided as follows.

$$\text{Fog density (\%)}=Dr-Ds$$

Fog densities obtained were evaluated according to criteria listed below.

A: 0.5% or less . . . very good

B: 0.6-1% or less . . . good

C: 1-2.0% or less . . . allowable level

D: 2% or more . . . poor

Those magnetic carriers which satisfied both a required level of charging rate and a required level of fog were only the carrier C according to the present invention, as shown in Table 1.

EXAMPLE 2

(8) Example 2

In this second example, a study was carried out with magnetic carriers D through H being added, in addition those of the above-mentioned first example, in order to clarify the relation among the carrier physical property values (∈, ρ), the charging rate and the fog. The carriers D through H were prepared according to a production method similar to that for the carrier C. At this time, the relative dielectric constant ∈ and the resistivity ρ of each magnetic carrier were controlled in the following manner by controlling the porous degree of a core and the resistance of a core material as well as an amount of resin such as silicone resin to be filled, an amount of resin of a coating resin, and so on. The measurement results of the physical property values (∈, $\in_0\in\rho$), fogs and charging rates of the magnetic carriers A through H were as follows. The dielectric constant $\in_0$ of a vacuum is a constant value.

TABLE 2

| | $E_{2D}$ | $E_{1L}$ | | Image output result | |
|---|---|---|---|---|---|
| | $\epsilon_0\epsilon\rho E_{2D}$ | $\epsilon_0\epsilon\rho$ | $\epsilon$ | Fog | Charging rate |
| Carrier A | 8 | $1\times10^{-4}$ | 15 | D | 78% |
| Carrier B | 78 | $2.8\times10^{-3}$ | 4 | A | 60% |
| Carrier C | 60 | $2\times10^{-4}$ | 35 | A | 95% |
| Carrier D | 31 | $1\times10^{-4}$ | 40 | B | 100% |
| Carrier E | 20 | $6\times10^{-4}$ | 30 | C | 90% |
| Carrier F | 13 | $1\times10^{-4}$ | 40 | D | 100% |
| Carrier G | 73 | $6\times10^{-4}$ | 20 | A | 75% |
| Carrier H | 73 | $1.0\times10^{-3}$ | 30 | A | 75% |

As shown in Table 2, those magnetic carriers which satisfied both an allowable level of fog and a charging rate of 90% or more were the carriers C, D and E.

The reason for this is considered as follows. Under the above-mentioned conditions, those magnetic carriers which satisfied the allowable level of fog were the carriers B, C, D, E, G and H. These magnetic carriers satisfied a relation of $20\leqq\in_0\in\rho\ E_{2D}$ (s·V/cm) in the field strength $E_{2D}$ (V/cm).

Therefore, for a non-image part ($V_D$), the amount of counter charge remaining on the magnetic carrier is sufficiently large in the field strength $E_{2D}$ decided by the phase time T2 of the developing bias for which the toner is caused to move in the direction of the developer carrying member. The fog toner adhered to the non-image part can be collected due to this counter charge.

Next, under the above-mentioned conditions, those magnetic carriers which satisfied the allowable level of charging rate were the carriers C, D, E and F. These carriers satisfied a relation of $\in_0\in\rho$ (s) $6.0\times10^{-4}$ and a relation of $30\leqq\in$ in the field strength $E_{1L}$ (V/cm). Therefore, the amount of counter charge remaining on the magnetic carrier is sufficiently small in the field strength $E_{1L}$ applied to an image part ($V_L$) for the phase time T1 of the developing bias for which the toner is caused to move in the direction of the image bearing member.

Thus by making the time constant $\in_0\in\rho$(s) equal to or more than $6.0\times10^{-4}$, the counter charge is liable to reduce and it is possible to reduce the inhibition of movement of the toner due to the counter charge. Thereby the chargeability of the image part can be improved. In addition, because the relative dielectric constant ∈ of the magnetic carrier is sufficiently large, as making the relative dielectric constant ∈ equal to or more than 30, the electric field applied to the surroundings of the magnetic carrier becomes large, so the toner becomes liable to fly easily from the magnetic carrier. In addition, since the larger a value of a relative dielectric constant ∈ is and a electric field of the carrier becomes large, so that the toner becomes liable to fly easily from the magnetic carrier, in the viewpoint of the improvement of defective charging, there is no upper limit for the value of a relative dielectric constant ★. From the above, only the carriers C, D and E according to the present invention satisfy the scope of claim 1 of the present application.

EXAMPLE 3

(9) Example 3

In this third example, a study similar to that of the above-mentioned second example was made while fixedly keeping the field strength $E_{1L}$ to $3.7\times10^4$ [V/cm] but replacing the duty ratio and the peak to peak voltage Vpp of the second example with 70% and 1.33 kV, respectively, so as make the field strength $E_{2D}$ variable.

Specifically, a duty wave was used which has a frequency 5 kHz, a duty ratio of 70%, and a peak to peak voltage Vpp of 1.33 kV. The electric field strengths $E_{1L}$, $E_{2D}$ decided by the developing bias, the bright potential $V_L$ and the dark potential $V_D$ were as follows: $E_{1L}=3.7\times10^4$ [V/cm], and $E_{2D}=1.9\times10^4$ [V/cm].

Table 3 illustrates the measurement results of the physical property values (∈, $\in_0\in\rho$), fogs and charging rates of the magnetic carriers A through G at this time.

TABLE 3

| | $E_{2D}$ | $E_{1L}$ | | Image output result | |
|---|---|---|---|---|---|
| | $\epsilon_0\epsilon\rho E_{2D}$ | $\epsilon_0\epsilon\rho$ | $\epsilon$ | Fog | Charging rate |
| Carrier A | 9 | $1\times10^{-4}$ | 15 | D | 88% |
| Carrier B | 61 | $2.8\times10^{-3}$ | 4 | A | 70% |
| Carrier C | 61 | $2\times10^{-4}$ | 35 | A | 100% |
| Carrier D | 44 | $1\times10^{-4}$ | 40 | B | 100% |
| Carrier E | 24 | $6\times10^{-4}$ | 30 | C | 100% |
| Carrier F | 16 | $1\times10^{-4}$ | 40 | D | 100% |
| Carrier G | 61 | $6\times10^{-4}$ | 20 | A | 85% |
| Carrier H | 71 | $1.0\times10^{-3}$ | 30 | A | 85% |

As shown in Table 3, those magnetic carriers which satisfied both an allowable level of fog and a charging rate of 90% or more were the carriers C, D and E.

The reason for this is considered as follows. Under the above-mentioned conditions, those magnetic carriers which satisfied the allowable level of fog were the carriers B, C, D, E, G and H. These magnetic carriers satisfied a relation of $20\leqq\in_0\in\rho\ E_{2D}$ (s·V/cm) in the field strength $E_{2D}$(V/cm). Therefore, for a non-image part ($V_D$), the amount of counter charge remaining on the magnetic carrier is sufficiently large in the field strength $E_{2D}$ decided by the phase time T2 of the developing bias for which the toner is caused to move in the direction of the developer carrying member. The fog toner adhered to the non-image part can be collected due to this counter charge.

Next, under the above-mentioned conditions, those magnetic carriers which satisfied the allowable level of charging rate were the carriers C, D, E and F. These carriers satisfied a relation of $\in_0\in\rho(s)\leqq6.0\times10^{-4}$ and a relation of $30\leqq\in$ in the field strength $E_{1L}$ (V/cm). Therefore, for an image part ($V_L$), the amount of counter charge remaining on the magnetic carrier is sufficiently small in the field strength $E_{1L}$ decided by the phase time T1 of the developing bias for which the toner is caused to move in the direction of the image bearing member. Accordingly, it is possible to reduce the inhibition of movement of the toner due to the counter charge, and hence to decrease the deterioration of chargeability. In addition, because the relative dielectric constant ∈ of the magnetic carrier is sufficiently large, the electric field applied to the surroundings of the magnetic carrier becomes large, so the toner becomes liable to fly easily from the magnetic carrier.

From the above, only the carriers C, D and E according to the present invention satisfy the scope of claim 1 of the present application.

EXAMPLE 4

(10) Example 4

In this fourth example, a study similar to that of the above-mentioned second example was made while fixedly keeping the field strength $E_{1L}$ to $3.7\times10^4$ [V/cm] but replacing the duty ratio and the peak to peak voltage Vpp of the second example with 80% and 1.16 kV, respectively, so as make the field strength $E_{2D}$ variable. Specifically, a duty wave was used which has a frequency 5 kHz, a duty ratio of 80%, and a peak to peak voltage Vpp of 1.33 kV. The electric field strengths $E_{1L}$, $E_{2D}$ decided by the developing bias, the bright potential $V_L$ and the dark potential $V_D$ were as follows: $E_{1L}=3.7\times10^4$ [V/cm], and $E_{2D}=1.4\times10^4$ [V/cm].

At this time, the measurement results of the physical property values (∈, $\in_0\in\rho$), fogs and charging rates of the magnetic carriers A through G are as follows.

TABLE 4

| | $E_{2D}$ | $E_{1L}$ | | Image output result | |
|---|---|---|---|---|---|
| | $\epsilon_0\epsilon\rho E_{2D}$ | $\epsilon_0\epsilon\rho$ | $\epsilon$ | Fog | Charging rate |
| Carrier A | 8 | $1\times10^{-4}$ | 15 | D | 78% |
| Carrier B | 45 | $2.8\times10^{-3}$ | 4 | B | 6% |
| Carrier C | 45 | $2\times10^{-4}$ | 35 | B | 95% |
| Carrier D | 40 | $1\times10^{-4}$ | 40 | B | 100% |
| Carrier E | 22 | $6\times10^{-4}$ | 30 | C | 90% |
| Carrier F | 15 | $1\times10^{-4}$ | 40 | D | 98% |
| Carrier G | 45 | $6\times10^{-4}$ | 20 | B | 75% |
| Carrier H | 52 | $1.0\times10^{-3}$ | 30 | B | 75% |

As shown in Table 4, those magnetic carriers which satisfied both an allowable level of fog and a charging rate of 90% or more were the carriers C, D and E.

The reason for this is considered as follows. Under the above-mentioned conditions, those magnetic carriers which satisfied the allowable level of fog were the carriers B, C, D, E, G and H. These magnetic carriers satisfied a relation of $20\leqq\in_0\in\rho\ E_{2D}$ (s·V/cm) in the field strength $E_{2D}$ (V/CM).

Therefore, for a non-image part ($V_D$), the amount of counter charge remaining on the magnetic carrier is sufficiently large in the field strength $E_{2D}$ decided by the phase time T2 of the developing bias for which the toner is caused to move in the direction of the developer carrying member. Thus, the fog toner adhered to the non-image part can be collected due to this counter charge.

Next, under the above-mentioned conditions, those magnetic carriers which satisfied the allowable level of charging rate were the carriers C, D, E and F. These carriers satisfied a relation of $\in_0\in\rho(s)\leqq6.0\times10^{-4}$ and a relation of $30\leqq\in$ in the field strength $E_{1L}$ (V/cm).

Therefore, the amount of counter charge remaining on the magnetic carrier is sufficiently small in the field strength $E_{1L}$ applied to an image part ($V_L$) for the phase time T1 of the developing bias for which the toner is caused to move in the direction of the image bearing member. Accordingly, it is possible to reduce the inhibition of movement of the toner due to the counter charge, and hence to decrease the deterioration of chargeability. In addition, because the relative dielectric constant ∈ of the magnetic carrier is sufficiently large, the electric field applied to the surroundings of the magnetic carrier becomes large, so the toner becomes liable to fly easily from the magnetic carrier.

From the above, only the carriers C, D and E according to the present invention satisfy the scope of claim 1 of the present application.

EXAMPLE 5

(11) Example 5

In this fifth example, a study similar to that of the above-mentioned second example was made by replacing the duty ratio and the peak to peak voltage Vpp of the second example with 60% and 0.85 kV, respectively, so as make the field strength E1L variable. Specifically, a duty wave was used which has a frequency 5 kHz, a duty ratio of 60%, and a peak to peak voltage Vpp of 0.85 kV. The electric field strengths $E_{1D}$, $E_{2D}$ decided by the developing bias, the bright potential $V_L$ and the dark potential $V_D$ were as follows: $E_{1L}=2.3\times10^4$ [V/cm], and $E_{2D}=1.6\times10^4$ [V/cm]. The measurement results of the physical property values (∈, $\in_0\in\rho$), fogs and charging rates of the magnetic carriers I through L at this time were as shown in Table 5. The magnetic carriers I through L were also prepared according to a production method similar to that for the carrier C.

TABLE 5

| | $E_{2D}$ | $E_{1L}$ | | Image output result | |
|---|---|---|---|---|---|
| | $\epsilon_0\epsilon\rho E_{2D}$ | $\epsilon_0\epsilon\rho$ | $\epsilon$ | Fog | Charging rate |
| Carrier I | 24 | $6\times10^{-4}$ | 30 | C | 90% |
| Carrier J | 8 | $1\times10^{-4}$ | 40 | D | 95% |
| Carrier K | 48 | $6\times10^{-4}$ | 20 | B | 73% |
| Carrier L | 40 | $1.5\times10^{-3}$ | 30 | B | 70% |

As shown in Table 5, those magnetic carriers which satisfied both an allowable level of fog and a charging rate of 90% or more were the carrier I.

The reason for this is considered as follows. Under the above-mentioned conditions, those magnetic carriers which satisfied the allowable level of fog were the carriers I, K and L. These magnetic carriers satisfied a relation of $20\leqq\in_0\rho\ E_{2D}$ (s·V/cm) in the field strength $E_{2D}$ (V/cm).

Therefore, for a non-image part ($V_D$), the amount of counter charge remaining on the magnetic carrier is sufficiently large in the field strength of $E_{2D}$ decided by the phase time T2 of the developing bias for which the toner is caused to move in the direction of the developer carrying member. Accordingly, the fog toner adhered to the non-image part can be collected due to this counter charge.

Next, under the above-mentioned conditions, those magnetic carriers which satisfied the allowable level of charging rate were the carriers I and J. These carriers satisfied a relation of $\in_0\in\rho(s)\leqq6.0\times10^{-4}$ and a relation of $30\leqq\in$ in the field strength $E_{1L}$ (V/cm).

Therefore, the amount of counter charge remaining on the magnetic carrier is sufficiently small in the field strength of $E_{1L}$ applied to an image part ($V_L$) for the phase time T1 of the developing bias for which the toner is caused to move in the direction of the image bearing member. Accordingly, it is possible to reduce the inhibition of movement of the toner due to the counter charge, and hence to decrease the deterioration of chargeability. In addition, because the relative dielectric constant $\in$ of the magnetic carrier is sufficiently large, the electric field applied to the surroundings of the magnetic carrier becomes large, so the toner becomes liable to fly easily from the magnetic carrier.

From the above, only the carrier I according to the present invention satisfies the scope of claim 1 of the present application.

EXAMPLE 6

(12) Example 6

In this sixth example, a study similar to that of the above-mentioned fifth example was made while fixedly keeping the field strength $E_{1L}$ to $2.3\times10^4$ [V/cm] but replacing the duty ratio and the peak to peak voltage Vpp of the fifth example with 70% and 0.74 kV, respectively, so as make the field strength $E_{2D}$ variable.

Specifically, a duty wave was used which has a frequency 5 kHz, a duty ratio of 70%, and a peak to peak voltage Vpp of 0.74 kV. The electric field strengths $E_{1L}$, $E_{2D}$ decided by the developing bias, the bright potential $V_L$ and the dark potential $V_D$ were as follows: $E_{1L}=2.3\times10^4$ [V/cm], and $E_{2D}=1.3\times10^4$ [V/cm].

The measurement results of the physical property values ($\in$, $\in0\in\rho$), fogs and charging rates of the magnetic carriers I through L at this time were as shown in Table 6.

TABLE 6

| | $E_{2D}$ | $E_{1L}$ | | Image output result | |
|---|---|---|---|---|---|
| | $\epsilon_0\epsilon\rho E_{2D}$ | $\epsilon_0\epsilon\rho$ | $\epsilon$ | Fog | Charging rate |
| Carrier I | 23 | $6\times10^{-4}$ | 30 | C | 95% |
| Carrier J | 17 | $1\times10^{-4}$ | 40 | D | 100% |
| Carrier K | 55 | $6\times10^{-4}$ | 20 | B | 80% |
| Carrier L | 52 | $1.5\times10^{-3}$ | 30 | B | 78% |

As shown in Table 6, those magnetic carriers which satisfied both an allowable level of fog and a charging rate of 90% or more were the carrier I.

The reason for this is considered as follows. Under the above-mentioned conditions, those magnetic carriers which satisfied the allowable level of fog were the carriers I, K and L. These magnetic carriers satisfied a relation of $20\leqq\in_0\in\rho E_{2D}$ (s·V/cm) in the field strength $E_{2D}$ (V/cm). Therefore, for a non-image part ($V_D$), the amount of counter charge remaining on the magnetic carrier is sufficiently large in the field strength of $E_{2D}$ decided by the phase time T2 of the developing bias for which the toner is caused to move in the direction of the developer carrying member. Accordingly, the fog toner adhered to the non-image part can be collected due to this counter charge.

Next, under the above-mentioned conditions, those magnetic carriers which satisfied the allowable level of charging rate were the carriers I and J. These magnetic carriers satisfied a relation of $\in_0\in\rho(s)\leqq6.0\times10^{-4}$ and a relation of $30\leqq\in$ in the field strength $E_{1L}$ (V/cm).

Therefore, the amount of counter charge remaining on the magnetic carrier is sufficiently small in the field strength of $E_{1L}$ applied to an image part ($V_L$) for the phase time T1 of the developing bias for which the toner is caused to move in the direction of the image bearing member. Accordingly, it is possible to reduce the inhibition of movement of the toner due to the counter charge, and hence to decrease the deterioration of chargeability. In addition, because the relative dielectric constant $\in$ of the magnetic carrier is sufficiently large, the electric field applied to the surroundings of the magnetic carrier becomes large, so the toner becomes liable to fly easily from the magnetic carrier. From the above, only the carrier I according to the present invention satisfies the scope of claim 1 of the present application.

EXAMPLE 7

(13) Example 7

In this seventh example, a study similar to that of the above-mentioned fifth example was made while fixedly keeping the field strength $E_{1L}$ to $2.3\times10^4$ [V/cm] but replacing the duty ratio and the peak to peak voltage Vpp of the fifth example with 80% and 0.67 kV, respectively, so as make the field strength $E_{2D}$ variable. Specifically, a duty wave was used which has a frequency 5 kHz, a duty ratio of 80%, and a peak to peak voltage Vpp of 0.67 kV.

The electric field strengths $E_{1L}$, $E_{2D}$ decided by the developing bias, the bright potential $V_L$ and the dark potential $V_D$ were as follows: $E_{1L}=2.3\times10^4$ [V/cm], and $E_{2D}=1.0\times10^4$ [V/cm]. The measurement results of the physical property values ($\in$, $\in_0\in\rho$), fogs and charging rates of the magnetic carriers I through L at this time were as shown in Table 7.

TABLE 7

| | $E_{2D}$ | $E_{1L}$ | | Image output result | |
|---|---|---|---|---|---|
| | $\epsilon_0\epsilon\rho E_{2D}$ | $\epsilon_0\epsilon\rho$ | $\epsilon$ | Fog | Charging rate |
| Carrier I | 24 | $6\times10^{-4}$ | 30 | C | 90% |
| Carrier J | 18 | $1\times10^{-4}$ | 40 | D | 95% |
| Carrier K | 50 | $6\times10^{-4}$ | 20 | B | 73% |
| Carrier L | 40 | $1.5\times10^{-3}$ | 30 | C | 70% |

As shown in Table 7, those magnetic carriers which satisfied both an allowable level of fog and a charging rate of 90% or more were the carrier I.

The reason for this is considered as follows. Under the above-mentioned conditions, those magnetic carriers which satisfied the allowable level of fog were the carriers I, K and L. These magnetic carriers satisfied a relation of $20\leqq\in_0\in\rho E_{2D}$ (s·V/cm) in the field strength $E_{2D}$ (V/cm).

Therefore, for a non-image part ($V_D$), the amount of counter charge remaining on the magnetic carrier is sufficiently large in the field strength of $E_{20}$ decided by the phase time T2 of the developing bias for which the toner is caused to move in the direction of the developer carrying member. Accordingly, the fog toner adhered to the non-image part can be collected due to this counter charge.

Next, under the above-mentioned conditions, those magnetic carriers which satisfied the allowable level of charging rate were the carriers I and J. These carriers satisfied a relation of $\in_0\in\rho(s)$ $6.0\times10^{-4}$, and $30\leqq\in$ in the field strength $E_{1L}$ (V/cm).

Therefore, the amount of counter charge remaining on the magnetic carrier is sufficiently small in the field strength of E1L applied to an image part ($V_L$) for the phase time T1 of the developing bias for which the toner is caused to move in the direction of the image bearing member. Accordingly, it is possible to reduce the inhibition of movement of the toner due to the counter charge, and hence to decrease the deterioration of chargeability. In addition, because the relative dielectric constant $\in$ of the magnetic carrier is sufficiently large, the electric field applied to the surroundings of the magnetic carrier becomes large, so the toner becomes liable to fly easily from the magnetic carrier. From the above, only the carrier I according to the present invention satisfies the scope of claim 1 of the present application.

As described in the foregoing, in the present invention, the relative dielectric constant $\in$ and the resistivity $\rho$ of the magnetic carrier is set in such a manner that when the duty ratio (Du) is in the range of $60\leqq$duty ratio (Du) (%)$\leqq80$, the time constant $\in_0\in\rho p(s)$ of electric charge decay of the magnetic carrier in the field strength $E_{2D}$ becomes as follows: $20\leqq\in_0\in\rho\ E_{2D}$ (s·V/cm).

Accordingly, for the non-image part, the fog toner is collected by making use of the counter charge remaining on the magnetic carrier in the field strength $E_{2D}$ applied for the phase time T2 of the developing bias for which the toner is caused to move in the direction of the developer carrying member. As a result, the fog is improved.

In addition, making use of the fact that the relative dielectric constant $\in$ and the resistivity $\rho$ of the magnetic carrier have field strength dependence, the time constant $\in_0\in p(s)$ of electric charge decay of the magnetic carrier in the field strength $E_{1L}$ (=($V_1-V_L$)/(SD gap)) (V/cm) is controlled so as to satisfy the following relations: $\in_0\in\rho(s)$ $6.0\times10^{-4}$, and $30\leqq\in$. That is, the relative dielectric constant $\in$ and the resistivity $\rho$ of the magnetic carrier are controlled so as to satisfy these relations.

As a result, in the field strength $E_{1L}$ applied to the image part ($V_L$) for the phase time T1 of the developing bias for which the toner is caused to move in the direction of the image bearing member, it is possible to reduce the inhibition of movement of the toner due to the counter charge, and hence to decrease the deterioration of chargeability. In addition, by making the relative dielectric constant $\in$ of the magnetic carrier equal to or less than 30 (i.e., $30\leqq\in$), the electric field applied to the surroundings of the magnetic carrier becomes large, so the toner becomes liable to fly easily from the magnetic carrier.

As described above, the factors $\in$, $\in\rho$ of the magnetic carrier were controlled within desired ranges in the field strength $E_{2D}$ (=($V_2-V_D$)/(SD gap)) (V/cm), which decides the fog, and in the field strength $E_{1L}$ (=($V_1-V_L$)/(SD gap)) (V/cm), which decides chargeability. As a result, defective charging can be improved without deteriorating the fog, in particular for the image bearing member of high electrostatic capacitance. Accordingly, it becomes possible to provide image outputs while making high picture quality and high stability compatible with each other.

In addition, the electric field strength $E_{1L}$ in the developing direction was set to $3.7\times10^4$ (V/cm) in the first through fourth examples, and was set to $2.3\times10^4$ (V/cm) in the fifth through seventh examples, and a preferred range of the electric field strength $E_{1L}$ is set for the following reasons. For an upper limit of the electric field strength $E_{1L}$, it is necessary to set the upper limit to $4.2\times10^4$ (i.e., $E_{1L}$ (V/cm) $4.2\times10^4$) so as to prevent the occurrence of flaws on the image bearing member due to discharging.

Also, for a lower limit of the electric field strength $E_{1L}$, it is necessary to set the lower limit to $2.0\times10^4$ (i.e., $2.0\times10^4\leqq E_{1L}$ (V/cm)) so as to prevent the deterioration of developability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-102084, filed on Apr. 10, 2008, which is hereby incorporated by reference herein in its entirety.

What is claimed is:

1. An image forming apparatus comprising:

an image bearing member that bears an electrostatic image thereon;

a charging device that charges said image bearing member;

an exposure device that forms said electrostatic image by exposing a surface of said image bearing member, which has been charged to a dark potential $V_D$ by said charging device, thereby to change the image bearing member surface into a bright potential $V_L$;

a developing device that has a developer carrying member on which a developer including a toner and a magnetic carrier is carried; and a power supply that applies a developing bias on said developer carrying member;

wherein said developing bias is an oscillating voltage having a first peak voltage $V_1$ generating an electrostatic force in a first direction to cause said toner to move in a direction from said developer carrying member toward said image bearing member, and a second peak voltage $V_2$ generating an electrostatic force in a second direction to cause said toner to move in a direction from said image bearing member toward said developer carrying member, said first and second peak voltages being applied on said developer carrying member in an alternate manner;

a duty ratio Du (%), denoted by (T2/(T1+T2))×100, is in the range of $60\leqq Du\leqq80$, where T1 is a phase time in said first direction, and T2 is a phase time in said second direction;

said magnetic carrier has a characteristic that:

said magnetic carrier has a resistivity $\rho$ which decreases in accordance with an increasing electric field strength, and a relative dielectric constant $\in$ which increases in accordance with an increasing electric field strength;

a product of a time constant $\in_0\in\rho(s)$ of electric charge decay, which is denoted by a dielectric constant of a vacuum $\in_0$, the relative dielectric constant $\in$ of said magnetic carrier, and said resistivity $\rho$ in an electric field strength $E_{2D}$ decided by said second peak voltage $V_2$ and said dark potential $V_D$, and said electric field strength $E_{2D}$ satisfies a relation of $20\leqq\in_0\in\rho\ E_{2D}$ (s·V/cm); and said time constant $\in_0\in\rho(s)$ and said relative dielectric constant $\in$ in an electric field strength $E_{1L}$, which is decided by said first peak voltage $V_1$ and said bright potential $V_L$, satisfy the following relations: $\in_0\in\rho(s)\leqq6.0\times10^{-4}$, and $30\leqq\in$.

2. The image forming apparatus as set forth in claim 1, wherein said image bearing member has a value of electrostatic capacitance per unit area (C/S) of $1.5\times10^{-6}$ (C/S) or more.

3. The image forming apparatus as set forth in claim 2, wherein said image bearing member is provided with a photosensitive layer including amorphous silicon.

4. The image forming apparatus as set forth in claim 1, wherein said developing bias has a frequency f which satisfies a range of $3 \leqq f\,(\mathrm{kHz}) \leqq 8$.

5. The image forming apparatus as set forth in claim 1, wherein said electric field strength $E_{1L}$ satisfies a range of $2.0 \times 10^4 \leqq E_{1L}\,(\mathrm{V/cm}) \leqq 4.2 \times 10^4$.

6. The image forming apparatus as set forth in claim 1, wherein said magnetic carrier has a characteristic that a decrease rate of said resistivity to an electric field strength change in an electric field strength which is larger than a first predetermined electric field strength is larger than a decrease rate of said resistivity to an electric field strength change in an electric field strength which is smaller than said first predetermined electric field strength, and an increase rate of said relative dielectric constant to an electric field strength change in an electric field strength which is larger than a second predetermined electric field strength is larger than an increase rate of said relative dielectric constant to an electric field strength change in an electric field strength which is smaller than said second predetermined electric field strength.

7. The image forming apparatus as set forth in claim 6, wherein said magnetic carrier is constructed to have a porous core with voids therein filled with a resin.

8. The image forming apparatus as set forth in claim 7, wherein said core is coated with a resin.

* * * * *